US009551950B2

(12) United States Patent
Sato et al.

(10) Patent No.: US 9,551,950 B2
(45) Date of Patent: Jan. 24, 2017

(54) IMAGE FORMING APPARATUS

(71) Applicant: CANON KABUSHIKI KAISHA, Tokyo (JP)

(72) Inventors: Shun Sato, Ashigarakami-gun (JP); Masataka Mochizuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 13/895,510

(22) Filed: May 16, 2013

(65) Prior Publication Data

US 2013/0308970 A1 Nov. 21, 2013

(30) Foreign Application Priority Data

May 17, 2012 (JP) ..... 2012-113522
Mar. 26, 2013 (JP) ..... 2013-063797

(51) Int. Cl.
*G03G 15/02* (2006.01)
*G03G 15/00* (2006.01)

(52) U.S. Cl.
CPC ..... *G03G 15/0266* (2013.01); *G03G 15/5004* (2013.01)

(58) Field of Classification Search
CPC ..... G03G 15/0266; G03G 15/5004
USPC ..... 399/50
See application file for complete search history.

(56) References Cited

U.S. PATENT DOCUMENTS

2002/0141769 A1* 10/2002 Phillips ..... 399/38
2005/0111869 A1* 5/2005 Takami et al. ..... 399/89
2010/0239286 A1* 9/2010 Hanashi ..... 399/50
2012/0033984 A1* 2/2012 Ikeda ..... 399/50
2013/0177328 A1* 7/2013 Fukuda ..... G03G 15/0266 399/43

FOREIGN PATENT DOCUMENTS

JP 63-149668 A 6/1988
JP 2001-201921 A 7/2001
JP 2005-156599 A 6/2005
JP 2011053346 A * 3/2011

OTHER PUBLICATIONS

Takami. Machine Translation of JP2005156599. Pub. Jun. 2005. Translated Jan. 2015.*
Tokushige. Translation of Abstract of JP2011053346. Pub. Mar. 2011. Translated Jan. 2015.*

* cited by examiner

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

An image forming apparatus for forming an image on a sheet includes an image bearing drum; a charging member for charging the drum by applying a voltage while contacting the drum; an AC voltage generating unit for generating and applying an AC voltage to the charging member; a state detector for detecting a state of the apparatus; a discharge current detector for detecting a discharge current between the charging member and the drum; a discharge current control unit for controlling the AC voltage generating unit on the basis of a result of detection of the discharge current detector; and a discriminating unit for discriminating whether to calibrate the discharge current detector before formation of the image, in accordance with a result of detection of the state detector.

13 Claims, 13 Drawing Sheets

IMAGE FORMING APPARATUS

FIELD OF THE INVENTION AND RELATED ART

The present invention relates to an image forming apparatus including an image bearing member, and a charging member contacted to the image bearing member and supplied with a voltage, the image forming apparatus forming a image using an image forming process including a charging of the image bearing member by said charging member.

The image bearing member may be an electrophotographic photosensitive member in an electrophotographic image formation type system, a dielectric member for electrostatic recording in an electrostatic recording image formation type system, or the like.

The image forming apparatus includes following type apparatuses:

1. An apparatus in which an image is formed on a surface of the image bearing member and is transferred directly onto a recording material or is transferred through an intermediary transfer member. Then, the image is fixed on the recording material as a fixed image, and the recording material is outputted as a print. Such an apparatus includes a copying machine, a printer, a facsimile machine, a complex function machine of such machines, or the like. After the image is transferred onto the recording material or the intermediary transfer member, the image bearing member is cleaned by a cleaning means, so that the image bearing member is used repeatedly for image formation.

2. An image display device such as a display screen device, an electronic black board device, electronic white board device or the like, in which the image formed on an image bearing member or an image transferred from the image bearing member onto an intermediary transfer member is displayed on a display portion. In the image display device, after the image is formed on the image bearing member or the intermediary transfer member and displayed on the display portion, the image is removed from the image bearing member or the intermediary transfer member by a cleaning means, so that the image bearing member or the intermediary transfer member is used repeatedly for image formation. In addition, if necessary, after image is formed on the image bearing member or the intermediary transfer member and displayed on the display portion, the image is transferred on a recording material. Then, the image is fixed on the recording material, which is then outputted as a print.

An example of an apparatus which is an image forming apparatus of an electrophotographic image formation type will be taken for explanation. The image forming apparatus includes, as the image bearing member, a rotatable electrophotographic photosensitive member (photosensitive drum) of a drum type or an endless belt type. A toner image (developer image) is formed on the surface of the photosensitive drum, using an electrophotographic image forming process including a step of uniformly charging the photosensitive drum to a predetermined potential of a predetermined polarity by a charging means.

As for the charging means (member) for the photosensitive drum which is a member to be charged, a corona charger is ordinarily used, the corona charger being of a non-contact charging type in which thin corona discharge wire is supplied with a high voltage to generate corona, which is applied onto the surface of the photosensitive drum.

Recently, however, a contact charging type charger has become widely used because it is advantageous in its low required voltage, low ozone production, low cost and the like. In the contact charging type, an electroconductive charging member (contact charging member) is contacted to the photosensitive drum, and is supplied with a voltage so that the surface of the photosensitive drum is charged uniformly to the predetermined polarity and potential. The charging member is an electroconductive roller (roller charging member or charging roller), for example.

In order to provide a desired potential Vd (charged potential) on the surface of the photosensitive drum in the contact charging type, the charging roller is supplied with a DC voltage Vd+Vth which is a discharge starting voltage (charging starting voltage) to the photosensitive drum at the time of application of the DC voltage to the charging roller.

For the purpose of further uniformalization of the charging, an AC charging type is used as disclosed in Japanese Laid-open Patent Application Sho 63-149668. In the AC charging type, the charging roller is supplied with a voltage in the form of superposed DC voltage corresponding to the desired potential Vd and an AC voltage component (AC voltage component) having a peak-to-peak voltage not less than twice the discharge starting voltage Vth. The voltage having the AC voltage component is a voltage having a periodically changing voltage value with time, and may be an alternating voltage, a pulsating current voltage or an oscillating voltage.

In the AC charging type, the charging can be made uniform by alternately providing positive discharge and negative discharge by the application of the AC voltage. For example, the applied AC voltage (oscillating voltage) comprises a DC voltage (DC offset bias) component and an AC voltage component having a peak-to-peak voltage not less than twice the discharge starting voltage Vth for the photosensitive drum upon application of the DC voltage only. By this, the photosensitive drum can be charged substantially uniformly.

When a sinusoidal wave AC voltage is applied to the charging roller, the current includes a resistance load current through a resistive load of the charging roller and the photosensitive drum, a capacity load current through a capacitive load between the charging roller and the photosensitive drum, and a discharge current between the charging roller and the photosensitive drum. A total of these currents flow in the charging roller. At this time, for stable charging by the charging roller, it is empirically known that the discharge current is not less than a predetermined value.

FIG. 14 shows a property between a charging AC voltage (Vc) applied to the charging roller and a charging current (Ic) flowing into the charging roller. The voltage Vc is a peak voltage value of the AC voltage, and the current Ic is an effective value of the AC current. The peak voltage value of the AC voltage is ½ of the peak-to-peak voltage of the AC voltage.

In FIG. 14, when an amplitude (peak voltage value) of the charging AC voltage (Vc) is gradually raised, the charging current (Ic) flows. When the charging AC voltage (Vc) is less than the predetermined voltage (Vth) the amplitude of the charging AC voltage is substantially proportional to the charging current. This is because the resistance load current and the capacity load current are proportional to the voltage amplitude, and since the voltage amplitude (peak voltage) is small, the electric discharge phenomenon does not occur so that no discharge current flows.

When the amplitude of the charging AC voltage (Vc) is further increased, the electric discharge phenomenon starts at the predetermined voltage (Vth), and the relation between the charging AC voltage and the charging current (Ic) become non-proportional to each other, and the charging current (Ic) increases by the discharge current (Is). In order to provide stable charging, the charging voltage (Vt) is set so that the discharge current (Is) is not less than the predetermined value.

However, when the discharge current (Is) to the photosensitive drum increases, a deterioration of the photosensitive drum such as photosensitive drum scraping is promoted, and an abnormal image such as image deletion may occur by an electric discharge product. For this reason, in order to provide the stabilized charging and to avoid the problem, it is desired that a necessary minimum charging AC voltage is applied to produce the minimum alternating positive and negative discharge.

Actually, however, the relation between the applied voltage to the photosensitive drum and the discharge amount is not always constant but changes with the changes of the film thickness of the photosensitive layer or the dielectric layer of the photosensitive drum, ambient condition of the charging member or the charging member, and so on. Under a low temperature and low humidity ambience (L/L ambient condition), the material is dry with the result of increased resistance value so that the discharge occurs less easily, and therefore, in order to provide the uniform charging, a peak-to-peak voltage not less than a predetermined is required.

Even if a minimum charging AC voltage for providing the uniform charging under the L/L ambient condition is applied, the discharge is more than necessary under a high temperature and high humidity ambience (H/H ambient condition) because under such a condition, the material is wet with the result of low resistance value. The excessive discharge amount will result in a production of image defect, toner, photosensitive drum scraping, short service life and so on.

It is known that such a change of the discharge is caused by the above-described variation of the ambient condition, and in addition by manufacturing variation of the charging roller, the resistance value variation attributable to the contamination of the charging roller, the variation of the electrostatic capacity of the photosensitive drum due to a long term use, a property variation of the high voltage generating device of the main assembly of the image forming apparatus, or the like.

In order to suppress the variation of such a discharge amount, Japanese Laid-open Patent Application No. 2001-201921 proposes a discharge current control type with which the AC voltage applied to the charging roller is variable. In this type, the property of AC voltage vs. AC current is detected in each of a voltage range in which the peak voltage of the AC voltage is less than the electric discharge phenomenon-start voltage (Vth) and in the voltage range in which the peak voltage is not less than Vth. From two property lines provided by the detections, an AC voltage providing an optimum discharge amount is calculated, and the voltage level of the peak voltage of the AC voltage applied to the charging member is determined.

In FIG. 14, white dots A, B, C, D are points where the detection is carried out. In the range of not more than the electric discharge phenomenon-start voltage (Vth), sampling is carried out at two points (A and B), and therefore, a property Line-A of charging AC voltage (Vc) vs. charging current (Ic) is determined for the range in which the discharge current does not occur. Similarly, by sampling at a two points (C, D) in the range in which the discharge occurs, a property Line-B of charging AC voltage (Vc) vs. charging current (Ic) is determined for the range in which the discharge current occurs.

From the relationships of the two property lines thus provided, a charging AC voltage for providing the predetermined value of the discharge current is calculated, and on the basis of the calculation result, the charging AC voltage is controlled, by which the variation of the discharge amount is suppressed.

In an image forming apparatus of the conventional discharge current control type, the sampling is carried out in an operational sequence of the image forming apparatus in a pre-rotation step. The pre-rotation step is a step which is carried out in a period prior to the image forming operation, after an image formation start signal is inputted when the image forming apparatus is in a stand-by state. That is, it is a period in which a main motor is started in response to the image formation start instruction to rotate the photosensitive drum, and predetermined preparatory operations for printing are carried out for predetermined process devices.

The sampling operations are carried out at points A, B, C, D, and on the basis of the results, the charging AC high voltage level is set, and thereafter, the printing step is carried out. By carrying out the sampling operations during a period outside the printing step, the production of abnormal image attributable to the charging voltage at the discharge starting voltage Vth can be prevented.

Japanese Laid-open Patent Application No. 2005-156599 discloses a first outputting means (unit), connected through a capacitive member in a path for supplying a current to a charging roller, for outputting information corresponding to a peak voltage of the AC voltage applied to the charging roller. It further discloses a second outputting means (unit), connected through a capacitive member, for outputting information corresponding to a change of the AC voltage applied to the charging roller. A control means (unit) determines a control value in the image forming operation, on the basis of a result of outputs of the first outputting means and the second outputting means at the time when an AC voltage having a peak voltage not less than a discharge starting voltage Vth for the photosensitive drum is applied by the AC voltage generating means (unit).

By doing so, a high precision and constant amount discharge operation is accomplished irrespective of the ambient condition and the property variation of the charging roller due to the manufacturing tolerances.

Recently, the demand for energy saving is strong, and therefore, the frequency of occurrences of rest (sleep) state in which the electric energy consumption is minimized increases. With the conventional discharge current control, the calibration is carried out during the pre-rotation step to avoid the problem arising from the variation of the ambient condition and/or the property variation of the charging member due to the manufacturing tolerances. Therefore, the calibration for the discharge current control is carried out upon recovery from the sleep state, with the result of longer driving time is required until the printing output.

SUMMARY OF THE INVENTION

It is a object of the present invention to provide an image forming apparatus with which the time required for the calibration is short, while charging the image bearing member uniformly.

According to an aspect of the present invention, there is provided an image forming apparatus for forming an image on a recording material, said image forming apparatus comprising an image bearing member; a charging member for charging said image bearing member by applying of a voltage while contacting to said image bearing member; an AC voltage generating unit for generating and applying an AC voltage to said charging member; a state detecting unit for detecting a state of said image forming apparatus; a discharge current detecting unit for detecting a discharge current between said charging member and said image bearing member; a discharge current control unit for controlling said AC voltage generating unit on the basis of a result of detection of said discharge current detecting unit; a discriminating unit for discriminating whether to calibrate said discharge current detecting unit before formation of the image, in accordance with a result of detection of said state detecting unit.

These and other objects, features and advantages of the present invention will become more apparent upon a consideration of the following description of the preferred embodiments of the present invention taken in conjunction with the accompanying drawings.

Figure 7:
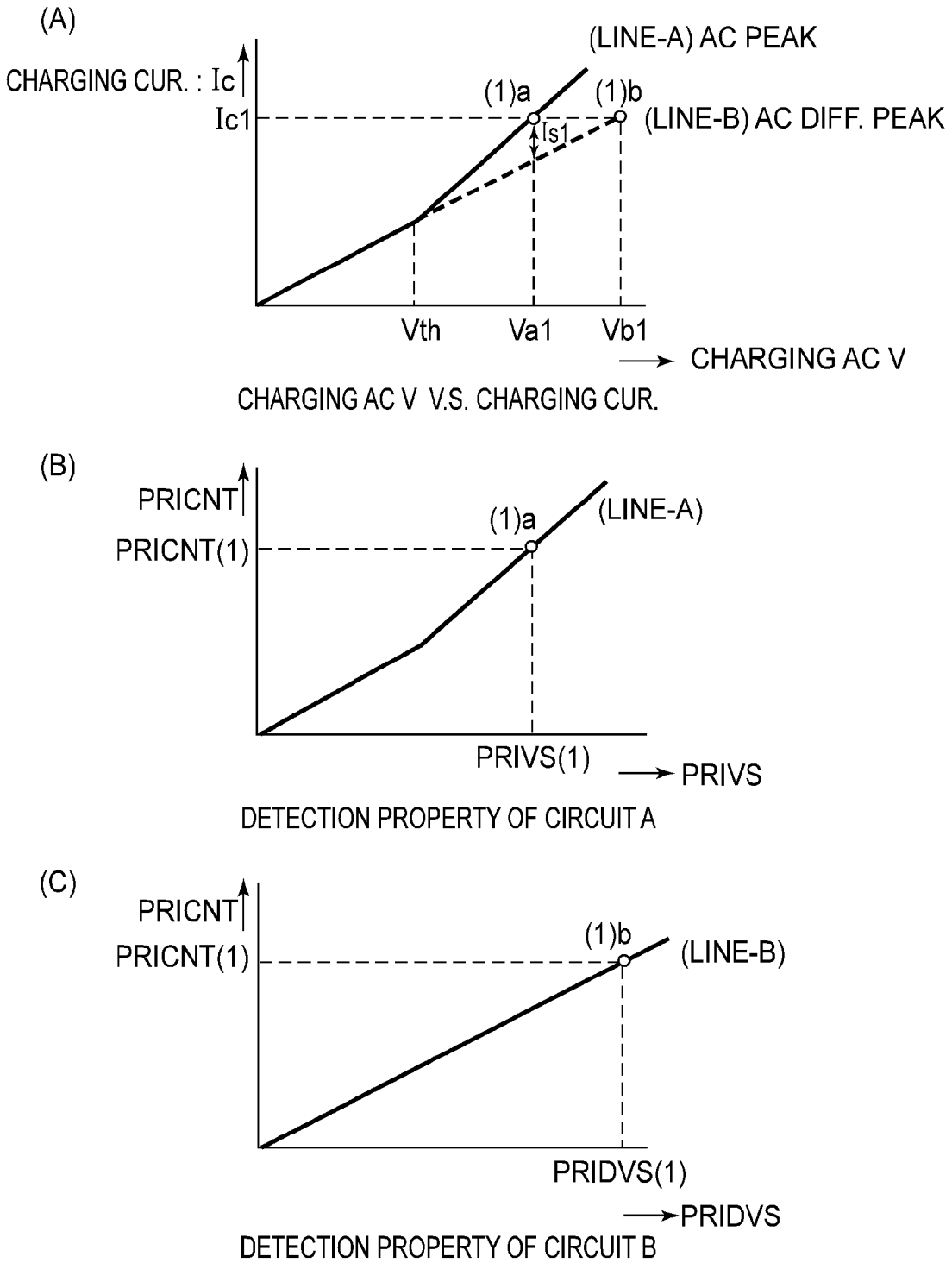

Part (A) of FIG. 7 shows a relationship between a peak value and a differential peak value of the charging AC voltage of the charging AC voltage applied to the charging roller 2, and a charging AC current (Ic), parts (B) and (C) show detection properties of the PRIVS and PRIVDS corresponding to (A).

Figure 8:
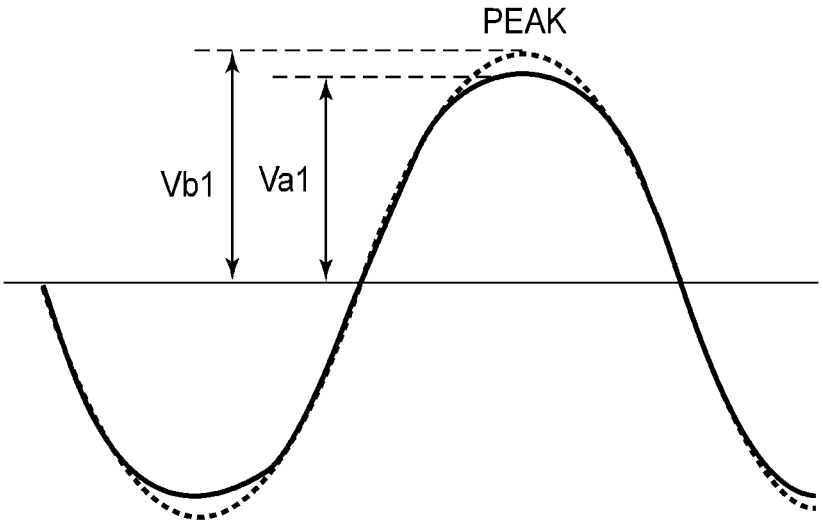

FIG. 8 shows a charging AC voltage waveform when the charging AC voltage is Va1 which is higher than the discharge start voltage (Vth) in (A) of FIG. 7.

Figure 9:
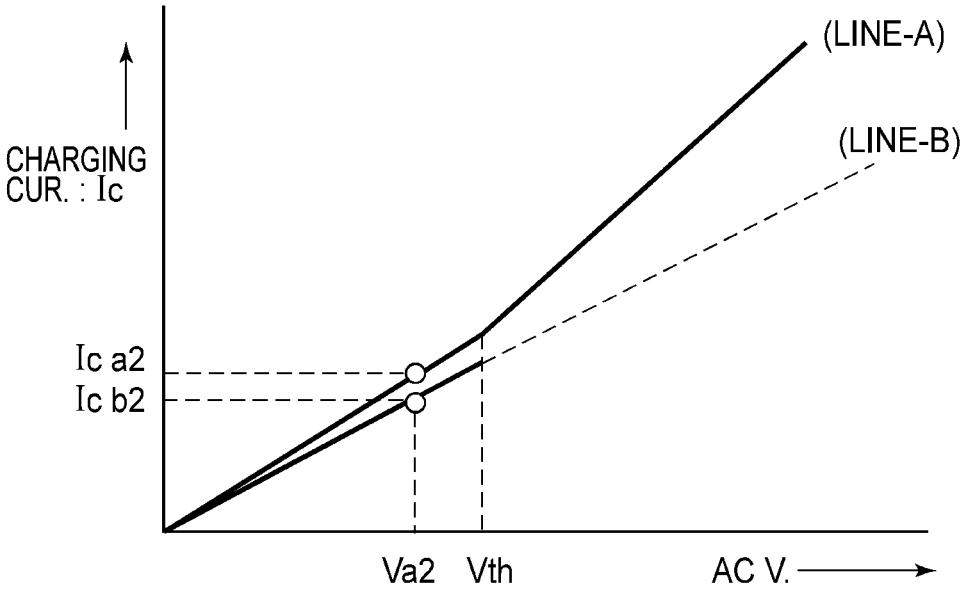

FIG. 9 shows a charging current when the charging AC voltage is Va2 which is lower than the discharge start voltage (Vth).

Figure 10:
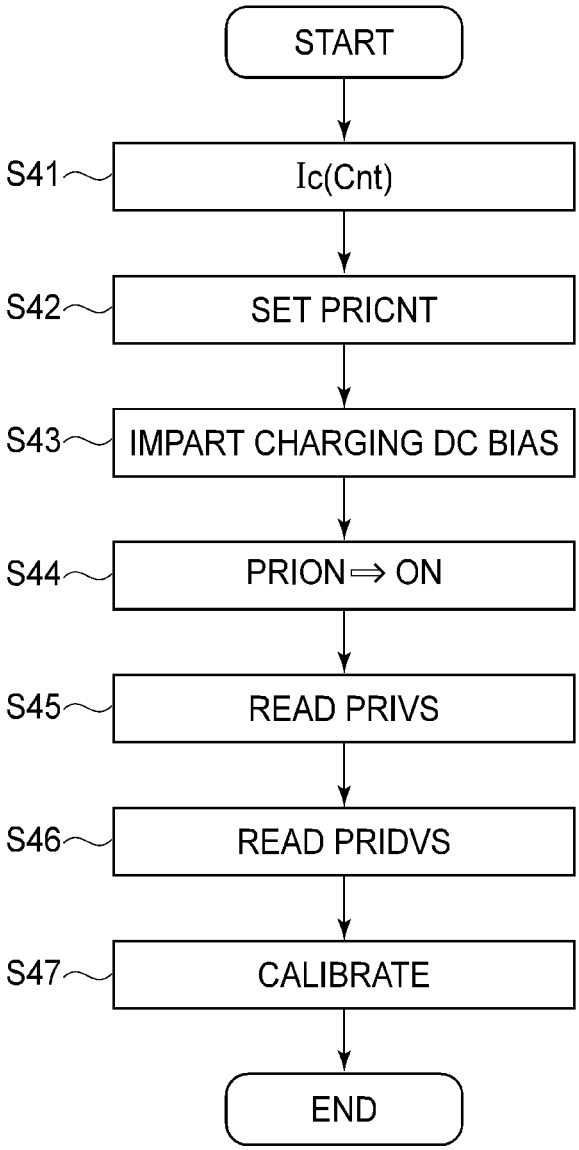

FIG. 10 is a flow chart showing a calibration process.

Figure 11:
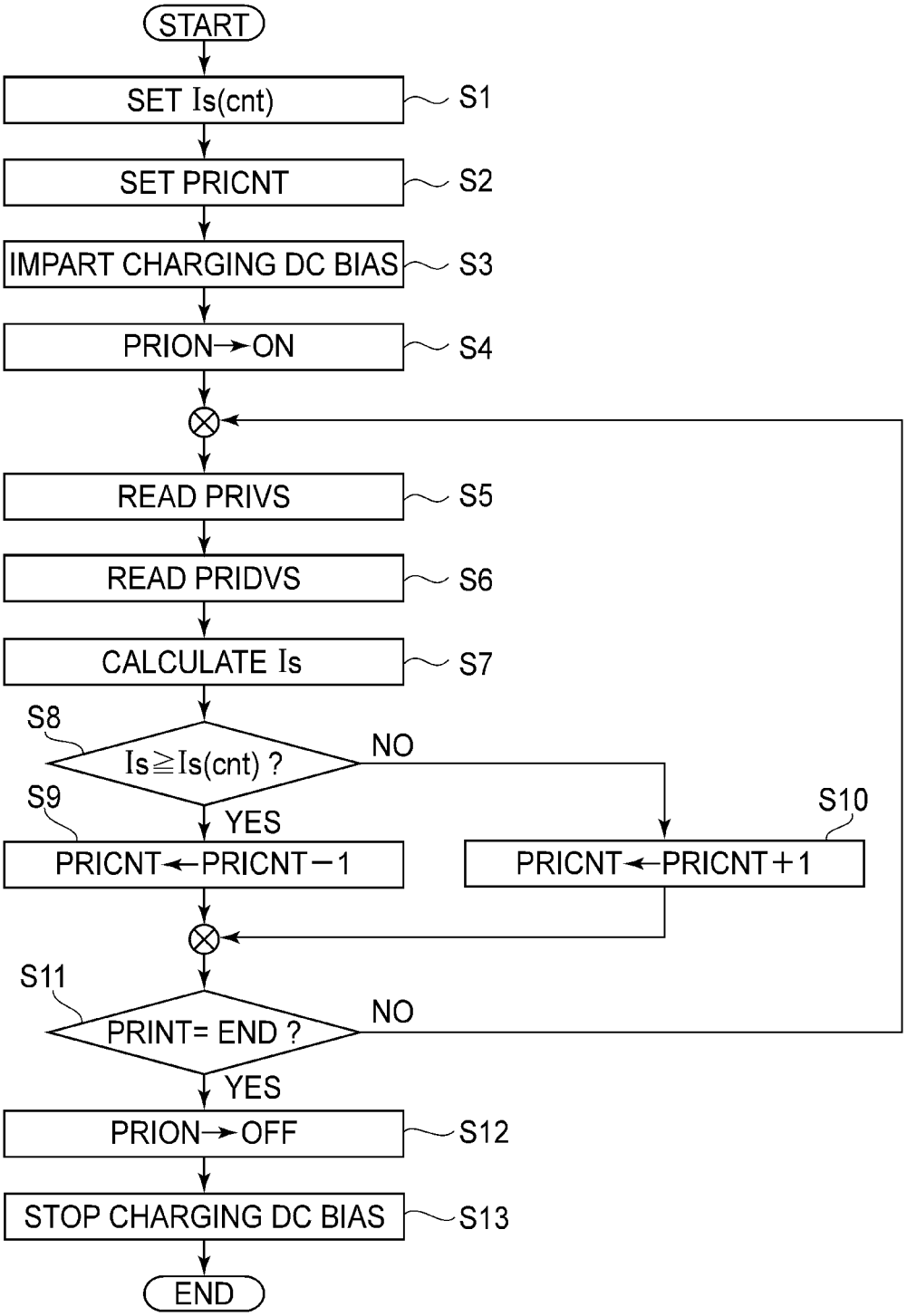

FIG. 11 is a flow chart showing a process of high charging voltage control in a printer.

Figure 12:
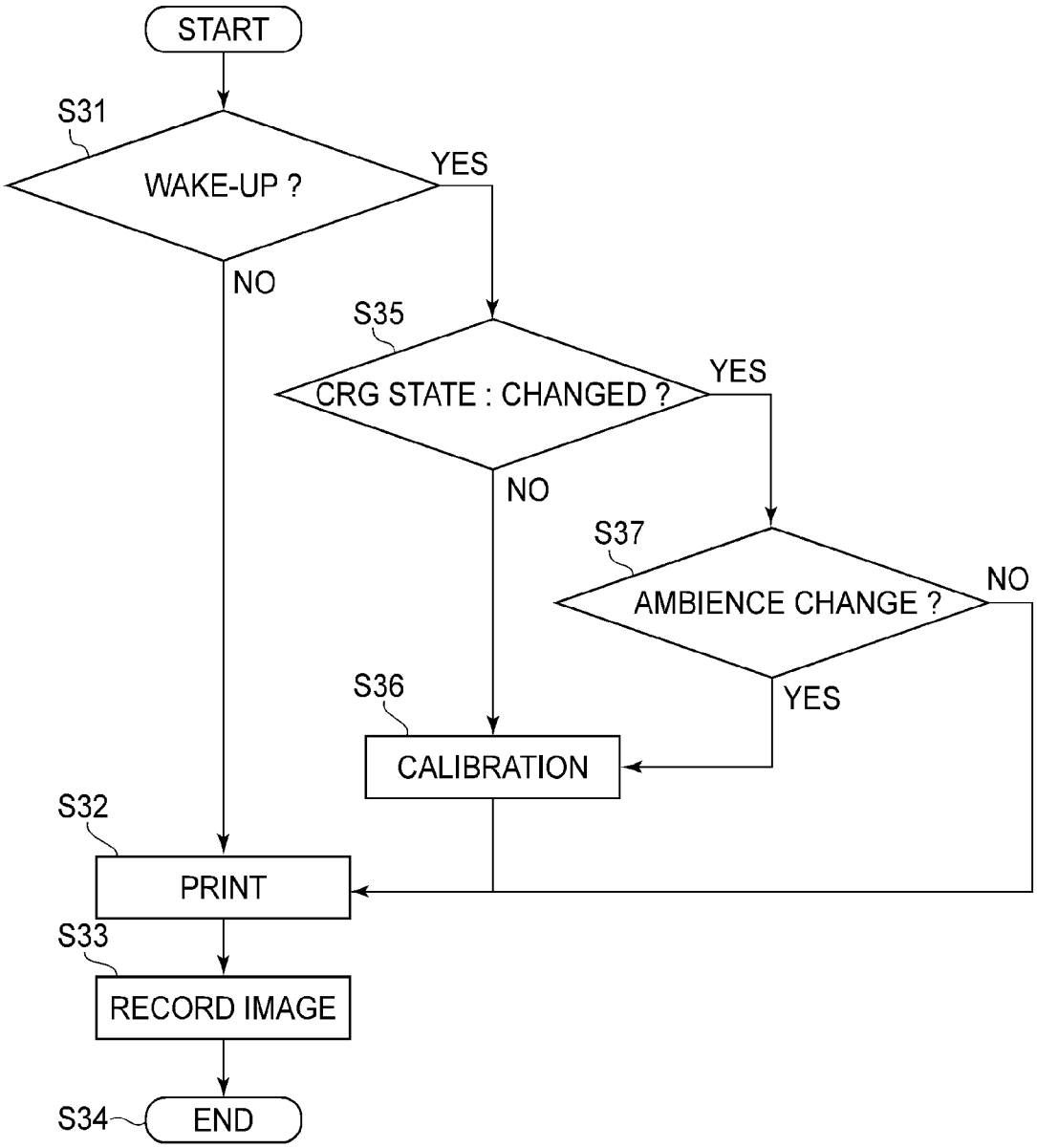

FIG. 12 is a flow chart of the control in embodiment 2.

Figure 13:
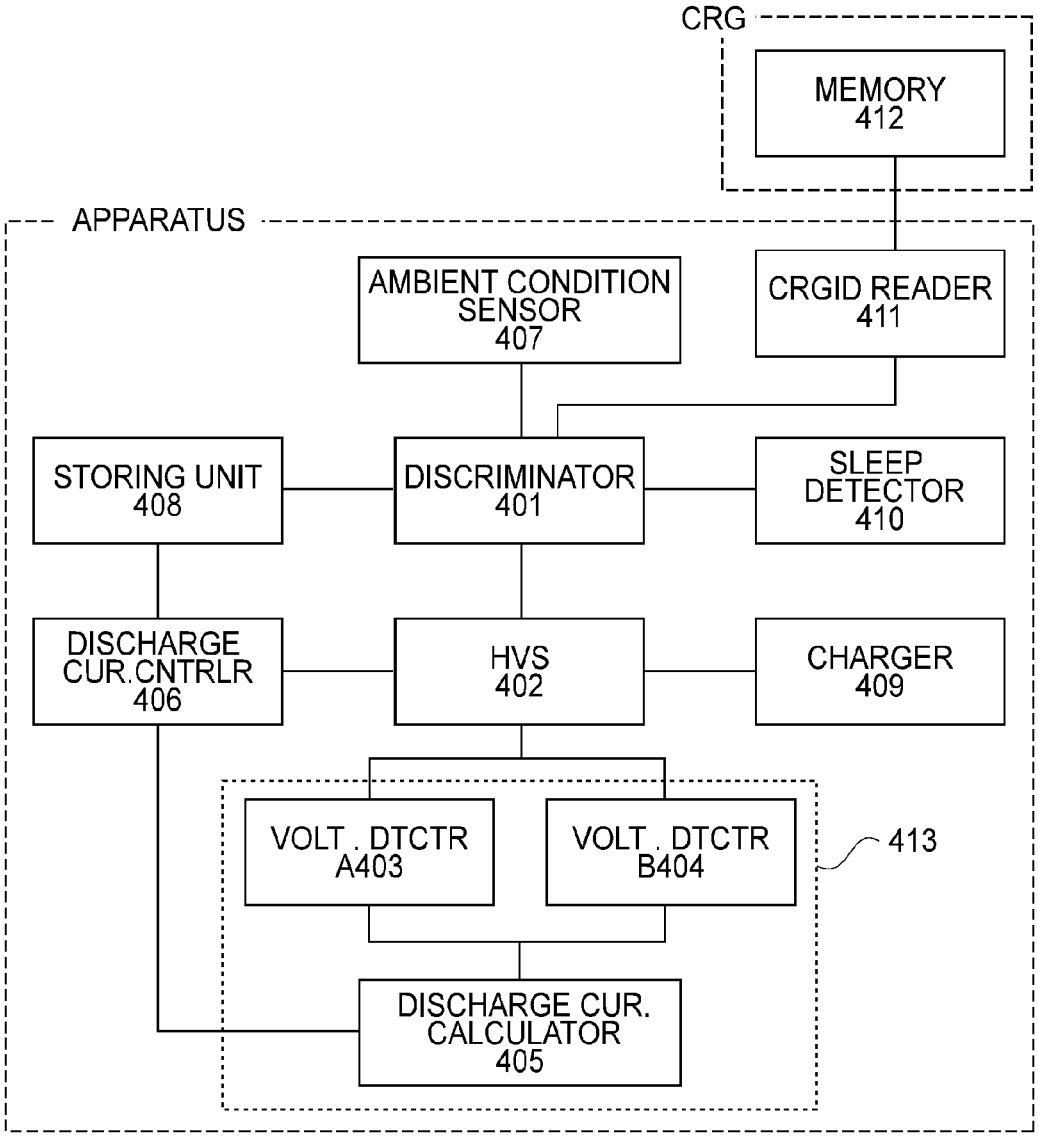

FIG. 13 is a block diagram illustrating a structure of the control in embodiment 2.

Figure 14:
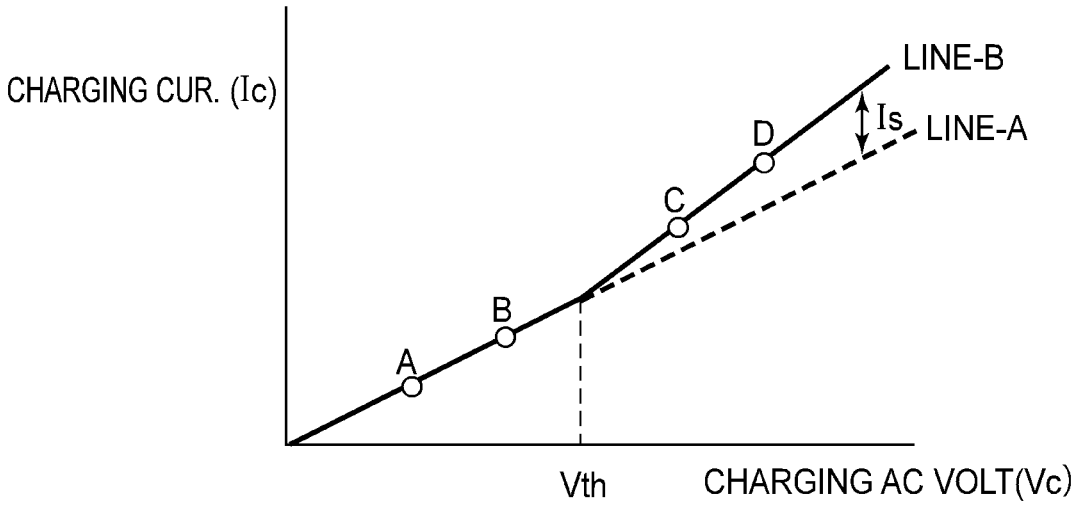

FIG. 14 shows a conventional discharge control.

DESCRIPTION OF THE EMBODIMENTS

The embodiments of the present invention will be described in detail, referring to the accompanying drawings.

Embodiment 1

Figure 2:
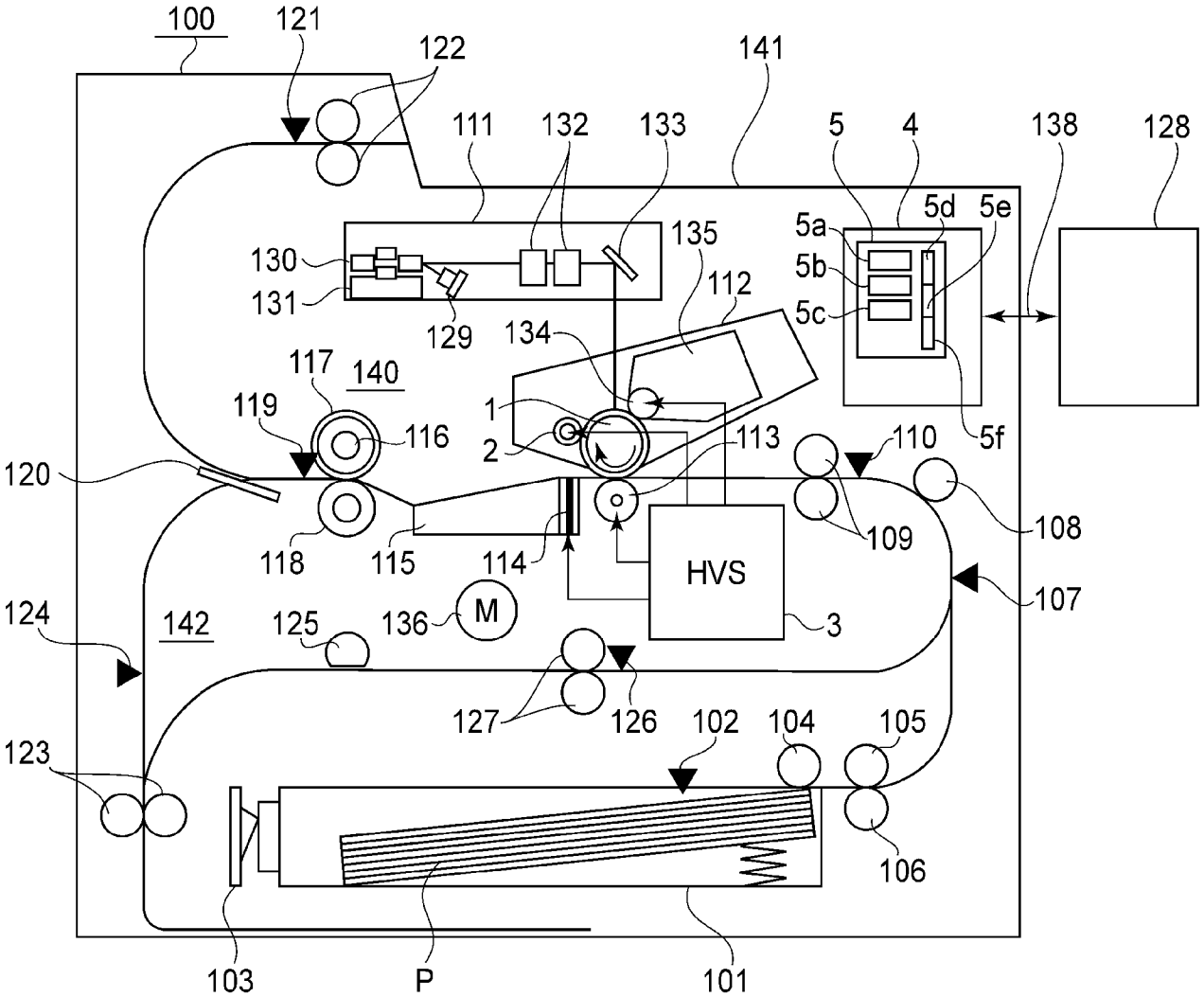
FIG. 2 is a schematic view of a printer.

FIG. 2 is a schematic illustration of an example of an image forming apparatus 100 according to an embodiment of the present invention. The image forming apparatus 100 of this embodiment is a laser beam printer using an image transfer type electrophotographic process (electrophotographic type image forming apparatus or printer). The apparatus 100 comprises a rotatable drum type electrophotographic photosensitive member 1 as an image bearing member, and an electroconductive charging roller 2 as a charging member which is contacted to the photosensitive drum 1 and is supplied with a voltage. The image formation is carried out by an electrophotographic process (image forming process) including a charging of the photosensitive drum 1 by the charging roller 2.

The printer 100 effects the image forming operation in response to an image signal inputted to a printer controller 4 from an external device 128 to form an image on a recording paper (recording material or recording material) P, and outputs a print.

The printer controller 4 controls overall the operations of the printer 100, and exchanges various electrical information signals with the external device 128 and/or a printer operating panel (unshown). It also governs process of the electrical information signal inputted from various process means and sensors, process of the instruction signals to various process means, a predetermined initial sequence control, and a predetermined image formation sequence control. The external device 128 may be a host computer, a network system, an image reader, a facsimile machine or the like.

Figure 1:
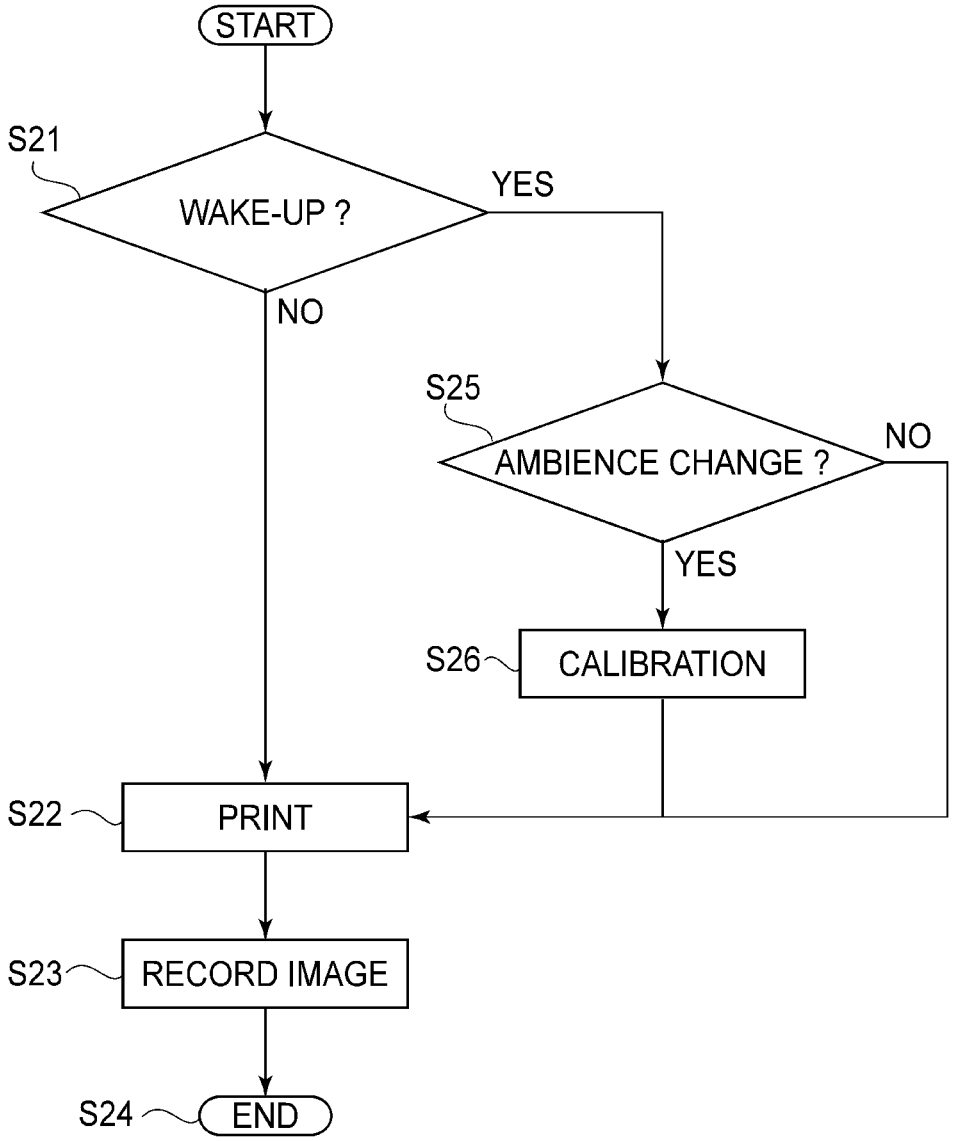
FIG. 1 is a flow chart of a control upon restoration from sleeping (wake-up) in a printer in embodiment 1.

FIG. 1 is a flow chart of the control upon recovery or restoration (wake-up) from the sleeping (rest) state of the printer 100. For the charging device for charging the photosensitive drum 1 with a discharge current control, it is discriminated whether or not the calibration of the charging condition upon the recovery of the printer 100 is required, so that the time required for the recovery from the sleep is minimized. First, the general structure of the printer 100 of FIG. 2 will be described, and then the control of the printer 100 will be described. In the following description, "downstream" is with respect to the feeding direction of the recording paper P.

(General Arrangement of Printer)

The printer 100 is provided with a deck 101 for accommodating the recording paper P. There are provided presence/absence sensor 102 for detecting presence or absence of the recording paper P in the deck 101, and a paper size sensor 103 for detecting a size of the recording paper P in the deck 101. The apparatus further comprises a pick-up roller 104 for feeding the recording paper P out of the deck 101. The apparatus further comprises a deck sheet feeding roller 105 for feeding the recording paper P picked up by the pick-up roller 104, and a retarding roller 106 for preventing double feeding of the recording paper P, the retarding roller 106 constituting a pair with the deck sheet feeding roller 105.

Downstream of the deck sheet feeding roller 105, there is provided a sheet feeding sensor 107 for detecting sheet feeding state from a reversing portion 142 which will be described hereinafter. The apparatus further comprises a feeding roller 108 for feeding the recording paper P toward the downstream, a pair of registration rollers 109 for feeding the recording paper P in synchronism with the image on the photosensitive drum, and a pre-registration sensor 110 for detecting a feeding state of the recording paper P to the registration roller pair 109.

Downstream of the registration roller pair 109, there is provided a process cartridge (CRG, image forming station) 112 for forming a toner image on the photosensitive drum 1 on the basis of the laser beam supplied from a laser scanner 111, which will be described hereinafter. The image forming apparatus further comprises a roller member 113 (transfer roller) for transferring the toner image formed on the photosensitive drum 1 onto the recording paper P, and a discharge member 114 (discharging needle) for assisting separation of the recording paper P at photosensitive drum 1 by removing the electric charge from the recording paper.

Downstream of the discharging needle 114, there are provided a feeding guide 115, and a fixing portion 140 which includes a pressing roller 118 and a fixing roller 117 provided with a heating halogen heater 116 therein to heat fix the toner image transferred onto the recording paper P.

The apparatus further comprises a fixing sheet discharge sensor 119 for detecting the state of recording paper feeding from the fixing portion 140, a flapper 120 for switching the feeding of the recording paper P between toward a sheet discharge portion 141 and toward the reversing portion 142 for both side printing. Adjacent the sheet discharge portion 141, there are provided a sheet discharge sensor 121 for detecting the recording paper feeding state to the sheet discharge portion 141, and a pair 122 of sheet discharging rollers for sheet discharging the recording paper P to the sheet discharge portion 141.

In the case of a both-side-printing mode, the recording paper P which has the image on one side and which is discharged from the fixing portion 140 is introduced to the reversing portion 142 by the flapper 120. The reversing portion 142 receives the recording paper P which has the image on one side and which is discharged from the fixing portion 140 and reverses the sheet in its facing orientation, and is reintroduced to the image forming station 112.

To accomplish this, the reversing portion 142 includes a pair of reversing rollers 123 for switching back the recording paper P by forward and reverse rotations, and a reversion sensor 124 for detecting the recording paper feeding state to the reversing roller pair 123. The apparatus further comprises a D-cut roller 125 for feeding the recording paper P from a lateral registration portion (unshown) for aligning the recording paper P in the widthwise direction of the recording paper P, and a both-side-printing sensor 126 for detecting the feeding state of the recording paper P in the reversing portion 142. The apparatus further comprises a pair of feeding rollers 127 for both side printing to feed the recording paper P from the reversing portion 142 to the image forming station 112.

The scanner portion 111 includes a laser unit 129 for emitting a laser beam modulated on the basis of the image signal fed from the external device 128 through the printer controller 4. It further includes a polygonal mirror 130 for scanning the photosensitive drum 1 with the laser beam from the laser unit 129, a scanner motor 131, an imaging lens group 132, and a fold-back mirror 133.

The process cartridge 112 includes the photosensitive drum 1 necessary for a known electrophotographic process, the charging roller 2 as the charging member, a developing roller 134, a toner container 135 or the like, wherein the process cartridge 112 is detachably mounted to the main assembly of the printer 100.

The photosensitive drum 1 is rotated in the clockwise direction (arrow) at a predetermined (process speed) speed. The charging roller 2 as the contact charging member is contacted to the photosensitive drum 1 at a predetermined urging force, and is rotated by the rotation of the photosensitive drum 1. The charging roller 2 is supplied with a predetermined charging bias voltage to electrically charge the surface of the rotating photosensitive drum 1 so as to uniformly charge the surface to a predetermined potential of a predetermined polarity.

The surface of the photosensitive drum 1 having been charged is exposed to the laser beam by the scanner portion 111 in the main scan direction, so that an electrostatic latent image is formed corresponding to an exposure pattern. The latent image is developed into a toner image by the developing roller 134, and the toner image is transferred onto the recording paper P by the transfer roller 113.

A high voltage source 3 includes a high voltage circuit for supplying desired voltages to the charging high voltage circuit which will be described hereinafter, and in addition to the developing roller 134, the transfer roller 113, and the discharging needle 114. Designated by 136 is a main motor for driving various parts of the apparatus.

The printer controller 4 for controlling the laser beam printer 100 includes an MPU (microcomputer) 5, and various I/O control circuits (unshown) or the like. The MPU 5 is provided with a RAM 5*a* and a ROM 5*b* as storing means (storing unit). In addition, it is provided with a timer 5*c*, the digital I/O port 5*d*, analog-digital conversion input port (A/D port) 5*e*, digital-analog output port (D/A port) 5*f* and so on. The printer controller 4 is connected to the external device 128 through an interface 138.

(Sequence During Printing Operation)

Figure 3:
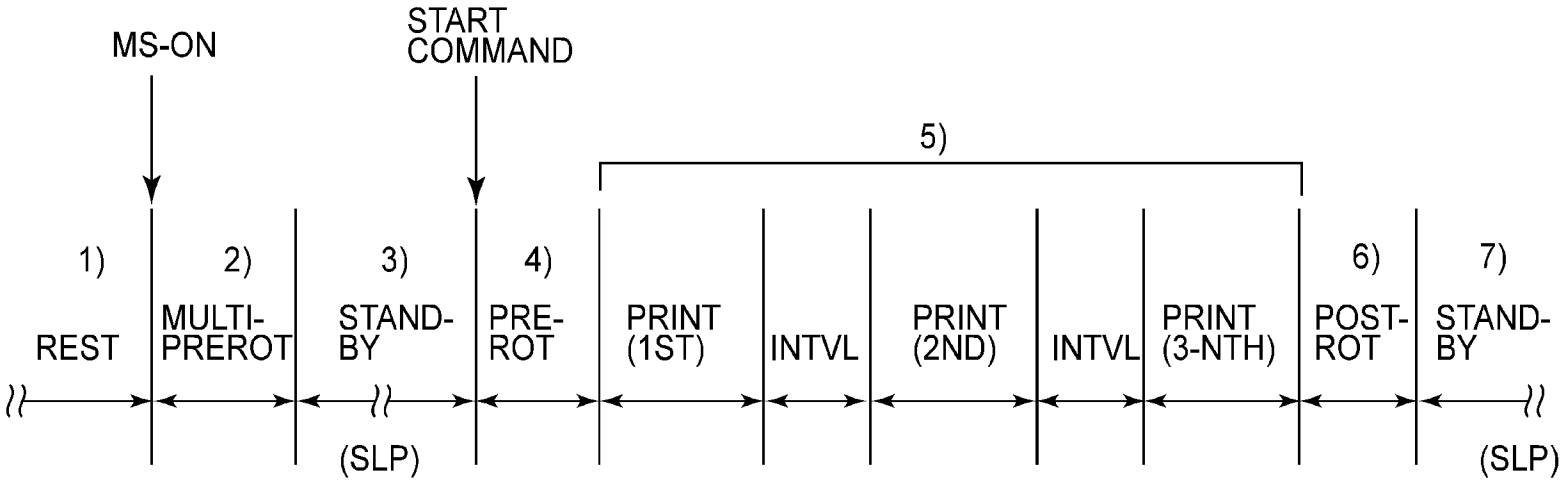
FIG. 3 shows an operational sequence of the printer.

FIG. 3 shows a sequence chart during the printing operation of the printer 100.

1) rest state: a main switch (unshown) of the printer 100 is in off-state. The printer 100 does not operate.

2) multiple pre-rotation step: this is carried out during a starting operation period (starting operation period, warming period) when the main switch is rendered ON. By the starting of the main motor 136, the photosensitive drum 1 is rotated. Preparing operations for the predetermined process means are executed. The fixing portion 140 is driven, and the temperature of the fixing roller 117 is raised to a predetermined level. In addition, a series of processes such as a discharge current calibration which will be described hereinafter is carried out.

3) stand-by state: after the predetermined multiple pre-rotation step operation is completed, the main motor 136 is stopped, and the apparatus is in the stand-by state in which the apparatus waits for a print start instruction (image formation start instruction, printing job start instructions) signal to be supplied from the external device 128 to the printer controller 4.

4) pre-rotation step: this is an operation period prior to the image formation; in this period, in response to the print start instruction, the main motor 136 is re-started to rotate the photosensitive drum 1, and predetermined preparatory operations for printing for the predetermined process means are carried out. More specifically, a) printer controller 4 receives the print start instruction from the external device 128, b) a formatter expands the image information (the required time is different if the amount of the data of the image information or the process speed is different), and c) the pre-rotation step starts.

If the print start instruction is produced during the multiple pre-rotation step (2), the operation of the apparatus goes to the pre-rotation step (4) without the stand-by state (3).

5) printing step: in this step, the printing operation is carried out for one (mono-print) or more continuous sheets (multi-print) in accordance with the inputted print start instruction. That is, when the pre-rotation step is completed, the printing step (image forming process) is executed to output a printed recording material.

In the case of the multi-print, the printing step is repeated, and the number of the printed sheets P are sequentially outputted. In the multi-print, a sheet interval step is an interval between the trailing edge of a recording paper P and a leading end of the subsequent recording paper P. In the sheet interval step, predetermined operations are carried out, and then the subsequent printing steps are carried out.

6) post-rotation step: after the completion of the printing step, predetermined printing ending operations are carried out for predetermined process devices. The main motor 136 is kept driven for a predetermined time, even after one print P is outputted (in the case of the mono-print) or even after the final print P is outputted (in the case of the multi-print). During this period, the operations after the image formation are carried out for the predetermined process devices.

7) stand-by state: after the completion of the post-rotation step, the main motor 136 is stopped, and the apparatus is placed in the condition of waiting for the print start instruction inputting to the printer controller 4 from the external device 128.

In the stand-by state of the above paragraphs 3) and 7) in the printer 100 of this embodiment, after a predetermined timer time, the apparatus is placed in the rest (sleeping) state in which the electric energy consumption is minimized. The image formation time of the printer 100 is the period from the start of the pre-rotation step (above paragraph 4)) to the end of the post-rotation step (above paragraph 6)). In the printer 100 of this embodiment, the process for determining the charging AC voltage level is continuously executed in the pre-rotation step (above paragraph 2)), the printing step (above paragraph 5)) and the sheet interval step, and on the basis of the result, the charging AC voltage level is controlled in real time.

(Control Structure)

Figure 4:
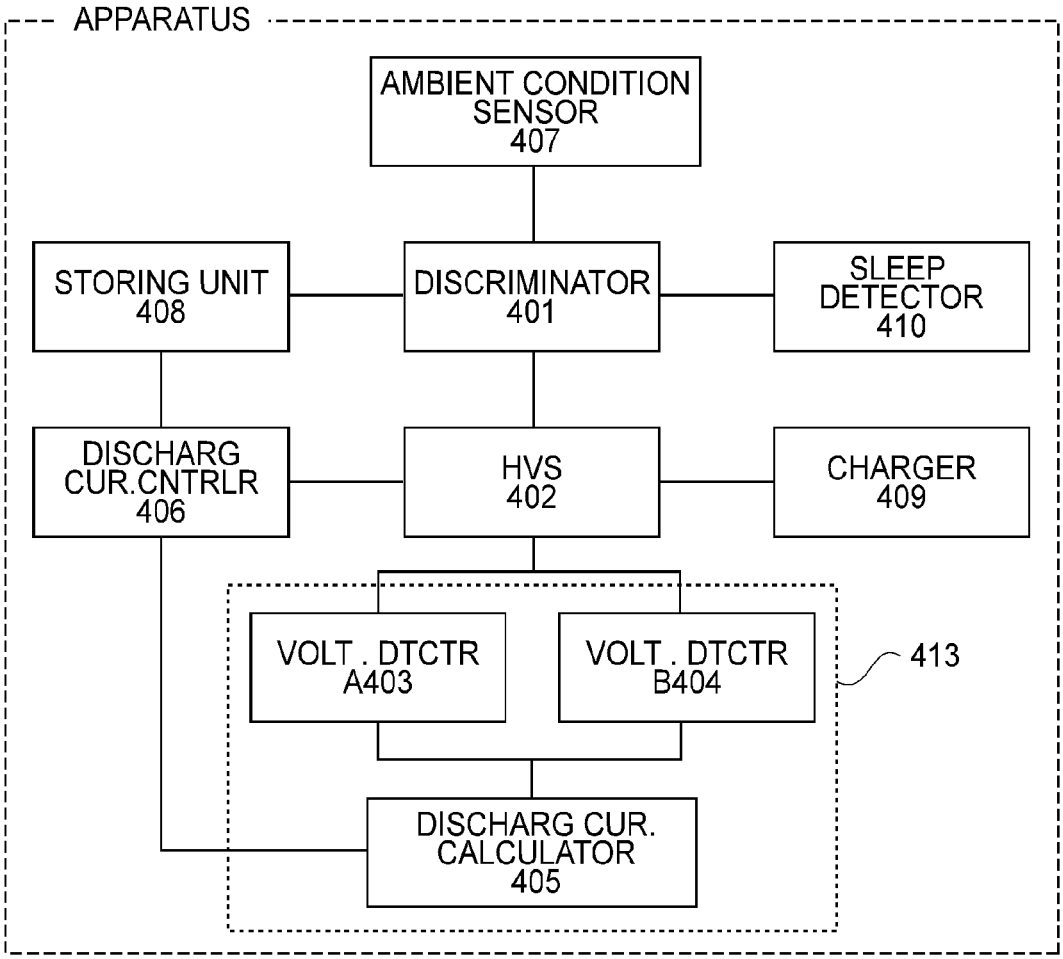
FIG. 4 is a block diagram illustrating a structure of the control.

FIG. 4 is a block diagram of the control structure (printer controller 4). A discriminating means (unit) 401 is connected with a sleeping detecting means (unit) 410, an ambience detecting means (unit) 407, a storing means (unit) 408 and a high voltage source (unit) 402. The high voltage source 402 is connected with the discriminating means 401, a discharge current control means (unit) 406, a charging device (unit) 409, a voltage detecting means (unit) A403 and a voltage detecting means (unit) B404.

The voltage detecting means A403 and the voltage detecting means B404 are connected with the high voltage source 402 and the discharging voltage calculating means (calculating unit) 405. A calculating means (unit) 405 is connected with the voltage detecting means A403, the voltage detecting means B404 and the discharge current control means 406. The discharge current control means 406 is connected with the calculating means 405, the high voltage source 402 and the storing means 408.

(Charging Bias Voltage Generation Circuit 6)

Figure 5:
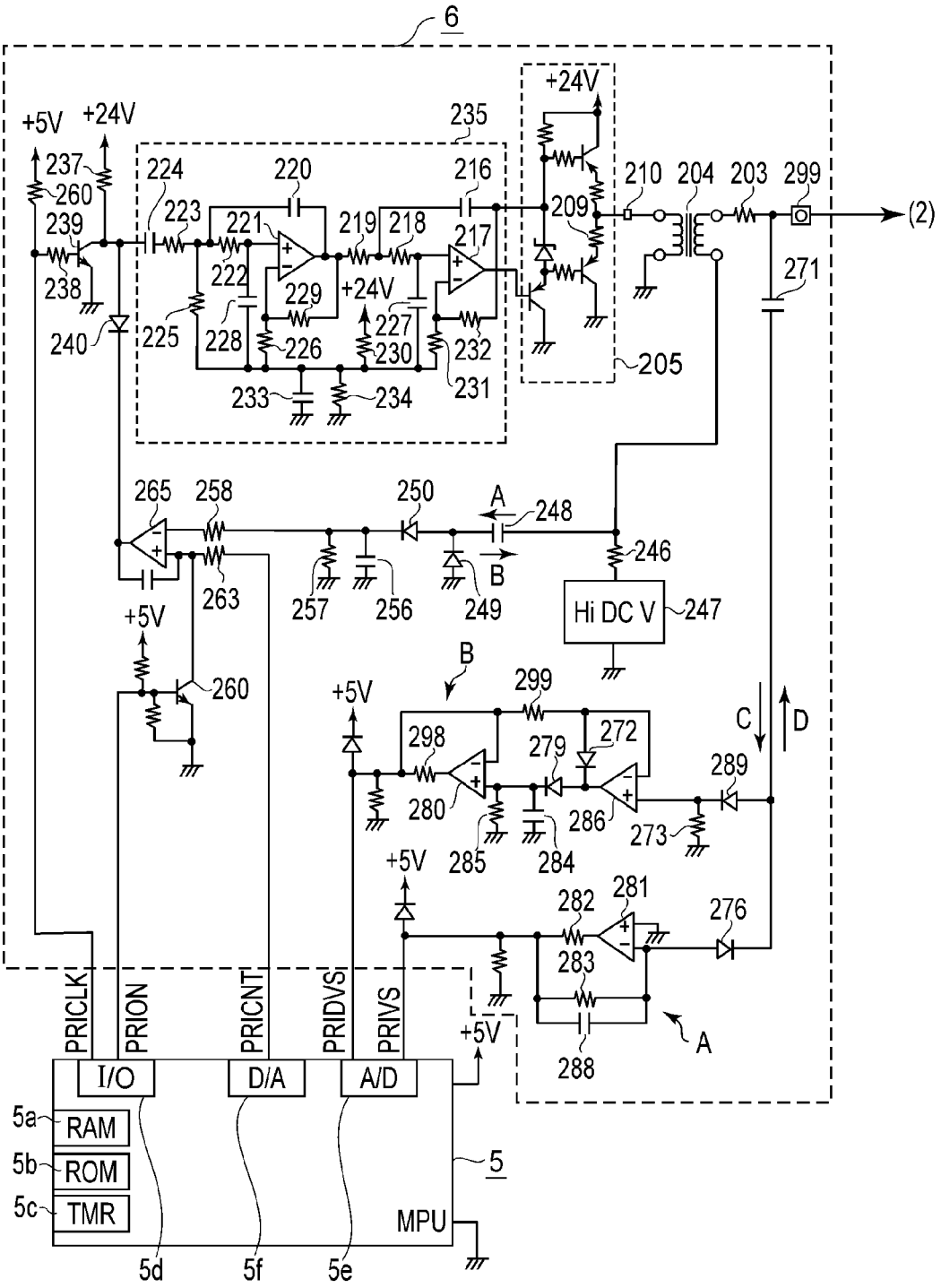
FIG. 5 is a block diagram illustrating a structure of a charging voltage control circuit.

FIG. 5 is a circuit diagram of the charging bias voltage generation circuit 6 of the printer 100, the circuit is provided in the printer controller 4, the same reference numerals as in FIG. 2 are assigned to the elements having the corresponding functions in this embodiment, and the detailed description thereof is omitted for simplicity, if appropriate. The charging bias voltage generation circuit 6 corresponds to the circuit provided with the high voltage source 402 and the voltage detecting units A403, B404 or the like.

The charging bias voltage generation circuit 6 as the high voltage source generates a charging voltage comprising a high DC voltage component and an AC high voltage superimposed thereto, and outputs the charging voltage from an output terminal 299. In other words, the charging bias voltage generation circuit 6 is an AC voltage generating means (unit) for generating the charging voltage to be applied to the charging roller 2.

When a clock pulse (PRICLK) is outputted from an I/O port 5*d* of the MPU 5, a transistor 239 effects a switching operation through a pull-up resistance 260, and a base resistance 238. It is amplified to a clock pulse having an amplitude corresponding to an output of an operational amplifier 265 connected through the diode 240 with the pull-up resistance 237.

When is amplitude is large, a driving voltage amplitude (peak voltage) of a sinusoidal wave inputted to a high voltage transformer 204 which will be described hereinafter is large, so that the peak voltage of the AC voltage is a high voltage and is also large.

The clock pulse is inputted to a filter circuit 235 through a capacitor 224. The circuit 235 comprises resistors 218, 219, 222, 223, 225, 226, 229, 230-234, capacitors 216, 220, 227, 228, 233, and operational amplifiers 217, 221.

From the filter circuit 235, a sinusoidal wave having a central value of +12V is outputted. The output is power-amplified by a push-pull high voltage transformer drive circuit 205, and is input to a primary winding of the high voltage transformer 204 through the capacitor 210. By this, an AC high voltage of the sinusoidal wave is generated in the secondary winding side of the high voltage transformer 204.

The above-described electric circuit portion of the charging bias voltage generation circuit 6 generates the AC voltage and applies it to the charging roller 2.

One of the secondary sides of the high voltage transformer 204 is connected with the high DC voltage generating circuit 247, and the generated high voltage bias of a DC high voltage superimposed by the AC high voltage is outputted from output terminal 299 through the output protective resistance 203. From the output terminal 299, a charging voltage bias (high voltage) is applied to the charging roller 2.

Then, the detection of an output AC current (It) of the charging bias voltage generation circuit 6 will be described. Here, by detecting a current through the secondary side winding of the high voltage transformer 204, a feed-back control is carried out in which an input voltage to the high voltage transformer drive circuit 205 corresponding to the output AC current (It) outputted from the output terminal 299 is generated.

The output AC current (It) generated by operating the above-described high voltage transformer drive circuit 205 flows through the capacitor 248, a half wave of the direction of an arrow A flows through the diode 250, and a half wave of the direction of an arrow B flows through the diode 249, respectively. The half wave of the direction A passed through the diode 250 is converted to a DC voltage by an integration circuit comprising the operational amplifier 265, the resistors 257, 258 and the capacitor 256. In this case, the voltage (Vn) at the negative input terminal of the operational amplifier 265 is expressed by the following (1):

$$Vn = Rs \times I\text{mean} \quad (1).$$

where Imean is an average of the half wave of the charging AC current (It), and Rs is a resistance value of the resistor 257.

On the other hand, to the positive input terminal of the operational amplifier 265, a current control signal (PRICNT) outputted from a D/A port 5*f* of the MPU 5 is inputted. The current control signal (PRICNT) is a signal for setting a driving voltage amplitude of the sinusoidal wave inputted to the high voltage transformer 204, that is, an amplitude level of the output AC current (It), and is an analog signal corresponding to a digital value PRICNT which changes within the range of 0V to 5V.

Here, when the voltage (Vn) at the negative input terminal of the operational amplifier 265 is lower than the current control signal (PRICNT), the output of the operational amplifier 265 is high. On the contrary, when the voltage (V1) at the negative input terminal is larger than that current control signal (PRICNT), the output of the operational amplifier 265 is low.

As described hereinbefore, when the output of the operational amplifier 265 is large, the amplitude of the clock pulse inputted to the filter circuit 235 is high, and the AC high voltage peak voltage is large. With such structures, the amplitude level of the AC high voltage (charging voltage) is controlled, and as a result, the output AC current (It) is controlled so as to be a predetermined constant current corresponding to the current control signal (PRICNT). That is, a constant-current-control corresponding to the current control signal (PRICNT) is carried out. The control value (PRICNT) of the charging AC current is expressed as follows:

$$I\text{mean}=\text{PRICNT}/Rs \quad (2).$$

The above-described electric circuit portion controls the AC voltage in the AC voltage generating means so that the constant current It corresponding to the control value (PRICNT) flows through the path for supplying the current in the charging roller 2 from the AC voltage generating means.

As will be described hereinafter, the discharge current between the charging roller 2 and the photosensitive drum 1 is determined in accordance with the AC current flowing from the AC voltage generating means (charging bias voltage generation circuit 6) into the charging roller 2. Thus, the discharge current control means 406 shown in FIG. 4 is constituted by the electric circuit portion (the circuit portion including the operational amplifier 265 and the filter circuit 235 and so on) and the MPU 5 outputting the PRICNT.

In addition, to the positive input terminal of the operational amplifier 265, the transistor 260 is also connected. The transistor 260 is driven by the signal (PRION) outputted from the I/O port 5*d* of the MPU 5. A high-level of the PRION signal actuates the transistor 260 by which the potential of the positive input terminal of the operational amplifier 265 is lowered to a low level so that the output of the charging AC voltage is rendered OFF.

(Voltage Detecting Circuit)

A voltage detector of the charging bias voltage generation circuit 6 will be described. In the charging bias voltage generation circuit 6, the voltage detector comprises a voltage detecting circuit A (A403) and a voltage detecting circuit B (B404). The voltage detecting circuit A corresponds to the voltage detecting means A403 shown in FIG. 4, and the voltage detecting circuit B corresponds to the voltage detecting means B404.

Figure 6:
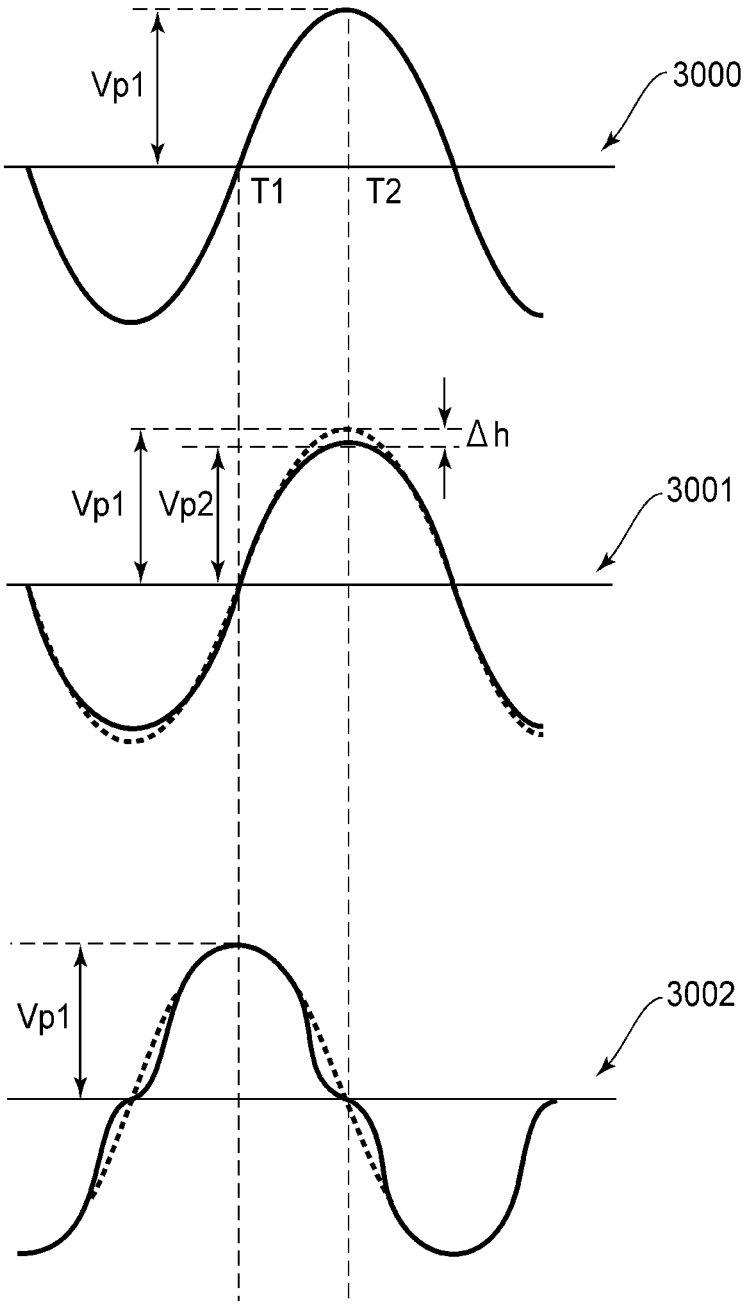
FIG. 6 shows a relation between a waveform of a charging AC voltage and a peak voltage value detected by a voltage detecting circuit A.

(A) Voltage Detecting Circuit A:

The voltage detecting circuit A detects a peak voltage value of the charging AC voltage. FIG. 6 shows a relation between a waveform of the charging AC voltage and a peak voltage value detected by the voltage detecting circuit A, in which the abscissa represents time, and the ordinate represents the charging AC voltage Vp.

Designated by 3000 corresponds to the case in which the waveform of the charging AC voltage is a sinusoidal wave. In this case, the voltage Vp1 is detected by the voltage detecting circuit A. Designated by 3001 corresponds to the case in which a peak portion of the AC voltage waveform is distorted. The waveform 3000 of the sinusoidal wave is indicated by a broken line, and the distortion occurs at the portion of the peak so that the peak voltage is lower than Vp1 by Δh. The voltage detecting circuit A detects the voltage Vp2.

The operation of the voltage detecting circuit A will be described. The peak voltage is detected by detecting a current flowing through the capacitor 271 connected to a line of the same potential as the charging voltage output terminal 299. Through the capacitor 271, the AC current corresponding to a voltage level of the charging AC voltage flows, and the current is divided by diodes 276 and 289. A half wave current of the direction of an arrow D flows through the diode 276, and the half wave current of the direction of an arrow C flows through the diode 289.

The half wave current of the direction of the arrow D is inputted to the integration circuit comprising operational amplifier 281, resistors 282, 283, and capacitor 288 and is converted to a DC voltage. The thus obtained peak voltage detection signal (PRIVS) corresponding to the DC voltage is inputted in an A/D port 5*e* of the MPU 5. The level of the peak voltage detection signal (PRIVS) is:

$$\text{PRIVS}=C271\times f\times R283\times 2\times Vp \quad (3)$$

where C271 is an electrostatic capacity of the capacitor 271, f is a frequency of the charging AC output, R283 is a resistance value of the resistance 283, and Vp is a peak voltage value (Vp1 in FIG. 6) of the charging AC voltage.

The voltage detecting circuit A is connected through the capacitor (capacitive member) 271 to the path for supplying the current to the charging roller 2 from the AC voltage generating means.

(B) Voltage Detecting Circuit B:

Voltage detecting circuit B detects a peak voltage value (corresponding to Vp2 in FIG. 6) of a differential waveform of the charging AC voltage waveform. The differential waveform is a waveform corresponding to the change of the charging AC voltage waveform, and it is maximum or minimum at the point of the oscillation center of the AC voltage waveform. Therefore, when the AC voltage waveform takes the peak voltage, the differential waveform shows no change.

Designated by 3002 in FIG. 6 is the differential waveform of the AC voltage waveform 3001. In FIG. 6, the differential waveform 3002 is the peak voltage (Vp1) at time T1 (vibration centers of the AC voltage waveforms 3000, 3001). At time T2 where the differential waveform 3002 does not change (vibration center), AC voltage waveforms 3000, 3001 take peak voltage (Vp1 or Vp2). The broken line represents the sinusoidal wave 3000. In the zone adjacent the peak where the waveform 3001 is distorted, the differential waveform 3002 is also distorted from the sinusoidal wave.

On the other hand, in the zone in which the wave 3001 is not distorted, the differential waveform 3002 is the same in shape as the sinusoidal wave, and the peak value is the same as the peak value Vp1 of the waveform 3001. That is, the voltage detecting circuit B detects the voltage Vp1 added by a distortion amount Δh for the peak voltage value (Vp2) of the distorted charging AC voltage waveform and outputs the detected voltage.

The operation of the voltage detecting circuit B will be described. The charging output voltage is divided by the capacitor 271 and the resistor 273 to be converted to a low voltage level. The diode 289 is connected between the capacitor 271 and the resistor 273, and therefore, a half wave of the AC waveform is inputted to the positive input of the operational amplifier 286. Here, the impedance of the capacitor 271 is sufficiently larger than the impedance of the resistor 273. Thus, at the positive input portion of the operational amplifier 286, a half wave form of the AC waveform of the divided differential waveform of the charging AC voltage is input.

The differential waveform is further converted to a DC voltage corresponding to the peak value of the AC waveform generated at the negative input terminal of the operational amplifier 281, by the peak voltage detecting circuit, and is inputted to the A/D port 5*e* of the MPU 5 as a differential voltage detection signal (PRIDVS). The peak voltage detecting circuit comprises the operational amplifier 286, the operational amplifier 280, the diodes 272, 279, the capacitor 284 and the resistors 285, 298, 299. The level of the differential voltage detection signal (PRIDVS) is:

$$\text{PRIDVS}=C271\times f\times R273\times\pi\times 2\times Vd \quad (4)$$

where C271 is an electrostatic capacity of the capacitor 271, f is a frequency of the charging AC voltage output, R273 is the resistance value of the resistor 273, n is circle ratio, and Vd is a peak voltage of the differential of the charging AC voltage.

From expressions (3) and (4), the peak voltage detection signal (PRIVS) and the differential voltage detection signal (PRIDVS) are proportional to the electrostatic capacity of the capacitor 271. As will be understood, even when the electrostatic capacity of the capacitor 271 varies due to the ambient condition or the like, a relative value between the signals is constant.

The voltage detecting circuit B is connected through the capacitor (capacitive member) 271 to the path for supplying the current to the charging roller 2 from the AC voltage generating means, and it functions as a second outputting means for outputting the information corresponding to the change of the AC voltage applied to the charging roller 2.

The MPU 5 calculates a discharge current on the basis of the result of the detections of the voltage detecting circuit A (first outputting means) and the voltage detecting circuit B (second outputting means). Thus, in this embodiment, the MPU 5 (FIG. 2) is the calculating means 405 of FIG. 4.

In this embodiment, a discharge current detecting means (unit) 413 of FIG. 4 is constituted by the MPU 5 (calculating means 405), the voltage detecting circuit A (voltage detecting means A403) and the voltage detecting circuit B (voltage detecting means B404).

(Discharge Current Detection)

The discharge current detecting method in this Embodiment 1 will be described. In the printer 100 of this Embodiment 1, the peak value of the charging AC voltage and the peak value of the differential value of the charging AC voltage are detected, and the discharge current value is calculated on the basis of the detections.

Part (A) of FIG. 7 shows a relation between the peak value of the charging AC voltage applied to charging roller 2 and the charging AC current (Ic), and a relation between the differential peak value of the charging AC voltage and the charging AC current. The charging current (Ic) flows by application of the charging AC voltage to the charging roller 2. In the zone (non-discharge generating region) of the charging AC voltage not more than the discharge starting voltage (Vth), the charging AC current linearly (proportionally) rises in proportion to the rise of the charging AC voltage. In the non-discharge generating region, only the nip current flows correspondingly to the resistive load and the capacitive load between the charging roller 2 and the photosensitive drum 1.

When the charging AC voltage rises beyond the discharge starting voltage (Vth), that is, in the discharge generating region, the electric discharge occurs between the charging roller 2 and the photosensitive drum 1, and the charging current (Ic) is the nip current plus discharge current.

In the non-discharge generating region, the charging AC voltage peak value and the peak value of the differentiated charging AC voltage are proportional to each other. However, in the discharge generating region, the peak value of the charging AC voltage, along the line A of part (A) of FIG. 7, and the peak value of the differentiated charging AC voltage is along the line A of part (A) of FIG. 7. In other words, in the discharge generating region, a difference exists between the property lines of the charging AC voltage and the differentiated charging AC voltage.

Referring to FIG. 8, the description will be made as to the cause of the difference between the lines A and B. FIG. 8 shows a charging AC voltage waveform when the charging AC voltage is higher than the discharge start voltage (Vth) of part (A) of FIG. 7, and a distortion of the waveform occurs in the neighborhood of the peak of the AC waveform.

The waveform distortion is produced because of the distortion caused in the output of the high voltage transformer 204 by the production of the discharge. When the charging AC voltage exceeds the discharge starting voltage (Vth), the discharge occurs at the timing adjacent the peak of the AC voltage to flow the discharge current. The discharge current flows instantaneously and rises sharply. Therefore, when the discharge current flows through the high voltage transformer 204 for generating the charging AC voltage, a voltage drop is produced between the output terminals of the high voltage transformer 204 because of the leakage inductance of the transformer 204, with the result of the distortion in the waveform of the output voltage.

At this time, the peak value of the charging AC voltage is Va1. On the other hand, the peak value of the differential value of the charging AC voltage is Vb1, which is the voltage Va1 plus the distortion amount. As a result, the property lines A and B become different.

As shown in part (A) of FIG. 7, line A is non-continuous at the discharge starting voltage (Vth). On the contrary, line B changes linearly relative to the peak value of the differential value of the charging AC voltage. This is because the output electric power of the high voltage transformer 204 is constant irrespective of the discharge by the operation property of the high voltage transformer 204.

The discharge current value can be calculated from the relation between the lines A and B. The peak value (Vp) of the charging AC voltage, the peak value (Vd) of the differential of the charging AC voltage, the discharge current value (Is) in the case of the charging current (Ic) satisfy, $$Is=Ic\times(Vd-Vp)/Vd \quad (5)$$

From expressions (5), (3) and (4), the discharge current is calculated by, $$Is=Ic\times(1-\pi\times R273/R283\times\text{PRIVS}/\text{PRIDVS}) \quad (6)$$

In the printer 100 of the Embodiment 1, the charging AC voltage peak value (Vp) is detected using the voltage detecting circuit A. The peak value (Vd) of the differentiated charging AC voltage is detected by the voltage detecting circuit B. The charging current (Ic) is set by PRICNT in the constant-current-control circuit constituted by the operational amplifier 265, the diodes 249, 250, the capacitors 248, 256 and so on.

Parts (B) and (C) of FIG. 7 show detection properties of the PRIVS and PRIVDS corresponding to part (A) of FIG. 7. When the charging AC current (Ic) is Ic1, the charging AC voltage peak value is Va1 in part (A), and PRIVS signal is PRIVS (1) (part (B)). In addition, in part (A), the differential peak value of the charging AC voltage is Vb1, and the PRIDVS signal at this time is PRIDVS (1), (part (C)). The discharge current (Is) can be calculated from the levels of the PRIDS and the PRIDVS detected by the MPU 5, using expression (6).

As will be apparent from expression (6), the capacity of the capacitor 271 has nothing to do with the calculated value of the discharge current (Is). That is, in the calculation of the discharge current in this Embodiment 1, the discharge current Is can be calculated accurately even when the property of the capacitor 271 changes due to a temperature change or the like.

(Discharge Current Control)

In the printer 100 according to Embodiment 1, in the pre-rotation step period, the printing step and the sheet interval step, the process of determining the charging AC voltage level is continuously carried out, and on the basis of the result of the determination, the charging AC voltage level is controlled in real time.

FIG. 11 is a flow chart illustrating a series of control process operations for the charging high voltage during the printing operation in the printer 100 according to embodiment 1. As described hereinbefore, the MPU 5 is a microcomputer which is a part of the discharge current detecting means 413 and the discharge current control means 406 shown in FIG. 4.

When the printing operation starts, the MPU 5 first sets the control value (Is (cnt)) of the discharge current in step S1. The control value (Is (cnt)) effects the setting using the value stored beforehand in the ROM 5*b* which is a storing means 408 of the main assembly. The operation goes to step S2 in which the PRICNT for setting an initial value of the constant-current-control level of the charging current is set, and the output voltage of the D/A port 5*f* is set. The set point is stored in the ROM 5*b* provided in the image forming apparatus.

Then, the operation goes to step S3 in which at the predetermined timing intermediate the pre-rotation step, the charging DC bias is actuated, and subsequently, in step S4, the charging AC bias driving signal (PRION) is made to be low. By this, the transistor 260 is switched off to output a charging AC bias from the operational amplifier 265. Then, in step S5-step S7, the discharge current is measured.

Here, in step S5, the detected value (PRIVS) by voltage detecting circuit A (voltage detecting means A) is read in, and then, in step S6, the detected value (PRIDVS) by the voltage detecting circuit B (voltage detecting means B) is read. In step S7, the MPU 5 (as discharge current detecting means) calculates the discharge current value (Is) using expression (6) on the basis of the values of the PRIVS, PRDVS read in the steps S5, S6.

Then, the operation goes to step S8, in which the MPU 5 (as discharge current control means) compares the discharge current value (Is) calculated in the step S7 and the set point (Is (cnt)) set in the step S1. When the discharge current value (Is) is larger than the set point (Is (cnt)), the operation goes to step S9 in which the PRICNT for setting the constant-current-control level of the charging current is reduced by a predetermined amount (1, here) to output the corresponding voltage from the D/A port 5*f*. By this, the control is carried out so as to decrease the level of the charging AC voltage.

On the other hand, if the discharge current value (Is) is smaller than the control value (Is (cnt)), the operation goes to step S10. The MPU 5 increases the PRICNT for setting the constant-current-control level of the charging current by a predetermined amount, and outputs the corresponding voltage from the D/A port 5*f*. By this, the control is carried out so as to increase the level of the charging AC voltage.

Subsequently, in step S11, the discrimination is made as to whether or not the printing is completed, and if the printing is to be continued, the operation returns to step S5, and the similar operations are repeated. By such a repeating process, the output of the charging AC voltage is controlled so that the discharge current value (Is) is at the desired level (Is (cnt)).

On the other hand, if the printing operation is completed in the discrimination at the step S11, the operation goes to step S12 in which the charging AC bias driving signal (PRION) is switched to the high-level to actuate the transistor 260, thus stopping the charging AC bias. Subsequently, in step S13, the charging DC bias is stopped, thus completing the series of processes.

The series of processes is continuously executed in the pre-rotation step period, the printing step and the sheet interval step, and therefore, the charging AC high voltage level is controlled in real time so that the discharge current value is always at the desired value.

As described in the foregoing, in the charging voltage control according to this Embodiment 1, the charging voltage output portion comprises one capacitor. By measuring the current flowing through the capacitor, the charging AC voltage peak value is detected. The peak value of the differentiated charging AC voltage is detected by measuring the voltage across the resistance connected with the capacitor in series. The discharge current is calculated from the detected charging AC voltage peak value and the peak value of the differentiated charging AC voltage, and the charging AC level is controlled so that the discharge current is at the desired level.

(Calibration)

Calibration of the discharge current control will be described. In this embodiment, before the image forming operation, the discharge current detecting means is calibrated by an AC voltage control means.

FIG. 9 shows a charging current when the charging AC voltage is Va2 which is lower than the discharge start voltage (Vth). As described above, when the charging AC voltage is smaller than the discharge starting voltage (Vth), the lines A and B are at the same level. If, however, the ambient condition or the like of the image forming apparatus changes, the line A and line B may be different from each other because of the property difference between the voltage detecting circuit A and the voltage detecting circuit B. When PRIVS is Ica2, and PRIDVS is Icb2 upon application of Va2 to the charging roller, the difference between Ica2 and Icb2 is the property difference between the circuits. When the property difference between the circuits occurs, the MPU 5 cannot determine the correct discharge current from the detection results of the voltage detecting circuit A and the voltage detecting circuit B. In order to prevent the influence of the property difference to the calculation result of the discharge current, the difference between Ica2 and Icb2 is determined as a correction value, and PRIVS and PRIDVS are corrected using the correction value.

The relationship between the voltage applied to the photosensitive drum 1 from the charging roller 1 and the discharge amount is not always constant, but it varies depending on film thicknesses of the photosensitive layer and/or the dielectric layer of the photosensitive drum 1, electronic parts, and the charging member due to the ambient condition variation (atmosphere) or the like. Under a low temperature and low humidity ambience (L/L ambient condition), the material is dry with the result of increased resistance value so that the discharge occurs less easily, and therefore, in order to provide the uniform charging, a peak-to-peak voltage not less than a predetermined value is required.

Even if a minimum charging AC voltage for providing the uniform charging under the L/L ambient condition is applied, the discharge is more than necessary under a high temperature and high humidity ambience (H/H ambient condition) because under such a condition, the material is wet with the result of low resistance value. In addition, there are differences among individual photosensitive drums 1 or the charging members 2 or the electronic parts.

Because of these causes, a difference arises between the detected value (PRIVS) of the voltage detecting circuit A and the detected value (PRIDVS) of the voltage detecting circuit B.

For example, as shown in FIG. 9, the detection result (PRIVS) of the voltage detecting circuit A may be larger than the detection result of the voltage detecting circuit B (PRIDVS). If the difference is not removed, the discharge current calculated by the MPU 5 is larger than the discharge current actually discharged. For this reason, if the charging AC voltage to be applied to the charging roller 2 from the AC voltage generating means is controlled on the basis of the calculated discharge current, the applied charging AC voltage is smaller than the required charging AC voltage. In other words, the discharge current actually discharged from the charging roller 2 to the photosensitive drum 1 may be insufficient.

To avoid such a problem, it is desirable that a calibration operation is carried out prior to the discharge current control operation.

Referring to FIG. 10, such a calibration process will be described. Upon start of the printing operation, a control value (Ic (cnt)) of the charging current is first set in step S41. The control value Ic (cnt) is a reference value for the charging current flowing into the charging roller 2. When the calibration is carried out, the voltage applied to the charging roller 2 is controlled so that the charging current flowing into the charging roller 2 is Ic (cnt). The control value Ic (cnt) is selected so as not to cause the discharge and is stored beforehand in the ROM 5*b* of the MPU 5.

The operation goes to step S42 in which the PRICNT for setting an initial value of the constant-current-control level of the charging current is set, and the output voltage of the D/A port 5*f* is set. The set point is stored in ROM 5*b* which is the storing means 408 provided in the printer 100.

Then, the operation goes to step S43 in which at predetermined timing during the pre-rotation step (during the before-image-forming operation period), the charging bias voltage generation circuit 6 generates a charging DC bias, and in step S44, the charging AC bias driving signal (PRION) is switched to a low level. By this, the transistor 260 is rendered off, so that the operational amplifier 265 outputs the charging AC bias set in step S42. Subsequently, in steps S45, 46, the charging current is measured.

Here, in step S45, the detected value (PRIVS) by voltage detecting circuit A (voltage detecting means A) is read in, and then, in step S46, the detected value (PRIDVS) by the voltage detecting circuit B (voltage detecting means B) is read.

Then, the operation goes to step S47, in which the MPU 5 compares the PRIVS and the PRIDVS detected by the steps S45, S46, and a calibration is effected by the difference between the PRIVS and the PRIDVS so that the PRIVS and the PRIDVS are the same. By such a process, the MPU 5 can calculate correct discharge amount as the discharge current detecting means (discharge current calculating means). The MPU 5 as the discharge current control means can correctly control the discharge current during the operation of the printer 100.

In the image formation after the calibration, the MPU 5 can properly carry out the control as follows, for example.

When the ambient condition changes from the H/H ambient condition to the L/L ambient condition, the discharge between the charging roller 2 and the photosensitive drum 1 occurs less easily. However, the above-described calibration by the MPU 5 provides correct detection of the discharge current. As a result, in the image forming operation after the calibration, the MPU 5 makes the set point of the charging current flowing into the charging roller 2 from the charging bias voltage generation circuit 6 higher than previous set point on the basis of the correct discharge current. Thus, the MPU 5 increases the charging AC voltage (peak value of the AC voltage in this embodiment) to increase the charging current flowing into the charging roller 2 from the charging bias voltage generation circuit 6. By doing so, even under the low temperature and low humidity ambience in which the discharge less easily occurs, proper control can be achieved.

In this manner, in this embodiment, when the ambient condition of the image forming apparatus changes, the discharge current detecting means comprising the voltage detecting circuit A, the voltage detecting circuit B, and the MPU 5 is calibrated. With such a structure, the discharge current in the discharge generating region can be correctly detected, the discharge current value can be controlled properly in the pre-rotation step period, printing step period and the sheet interval step period. By this, the uniform charging can be accomplished without the problem such as the deterioration of the photosensitive drum or the image defect, irrespective of the variation of the ambient condition and the property variation of the charging member due to the manufacturing tolerances, or the like.

(Controlling/Discriminating Mechanism)

Referring to FIG. 1, a series of charging high voltage control process steps in the recovery from sleeping of the printer 100 in this Embodiment 1 will be described. The MPU 5 discriminates the necessity of the calibration through the following process. In the following process, the MPU 5 functions as the discriminating means 401 shown in FIG. 4.

Upon start of the printing operation, the discrimination is made as to whether or not the operation is after the recovery from sleeping, using the sleeping detecting means (unit) 410 in the step S21. If not, the operation goes to a discharge current control step of FIG. 11, and the print is started by step 22. After the completion of the print, the ambient condition detected by the ambience detecting means (state detecting means for detecting the state of the printer 100) is stored in ROM 5*b* which is storing means (storing means for storing the detection result) 408 provided in the image forming apparatus, in step 23.

In this embodiment, the ambient condition of the printer 100 is divided into a high temperature and high humidity (HH), normal temperature and normal humidity (NN ambient condition) and low temperature and low humidity (LL ambient condition), and the as the discriminating means 401 selects one of them.

On the other hand, the discrimination in the step 21 is affirmative (recovery from sleeping), the operations are as follows. In step 25, the MPU 5 compares the ambient condition state in the current image formation obtained by the ambience detecting means 407 and the ambient condition state in the previous image formation using the recording means 406 so as to determine whether or not the ambient condition state is different from that before the recovery from sleeping.

If the current ambient condition is different from the previous one, the operation goes to step 26 in which the above-described calibration for the discharge current control (FIG. 10) is carried out in the multiple pre-rotating operation period. After the completion of the calibration process shown in FIG. 10, the printing operation is carried out (step 22). If there is no ambient condition variation upon the recovery from sleeping, the calibration shown in FIG. 10 is not carried out, and the operation goes to step 22. This is because in such a case, the correction value before the recovery from sleeping can be used.

Thus, the MPU 5 can compare the state of the printer 100 in the image forming operation from the rest state (sleeping) of the printer 100 and the state of the printer 100 upon the completion of the previous image forming operation (state comparison). In addition, during the before-image-forming-operation period, the necessity of the calibration of the discharge current detecting means is discriminated, and if not necessary, the calibration can be skipped.

As described in the foregoing, if no ambient condition variation is discriminated during the multiple pre-rotation after the recovery from sleeping, the calibration operation for the discharge current detecting means is not carried out. With such structures, the execution of the calibration upon the recovery from sleeping can be minimized. Therefore, high precision discharge with the proper amount can be effected, and the uniform charging can be effected, irrespective of the variation of the ambient condition or the property variation of the charging roller due to the manufacturing tolerances or the like, while suppressing the increase of the total drive time of the printer 100. In addition, later the recovery from sleeping, the image forming operation can be started quickly.

In addition, the drive time during the multiple pre-rotation is short, so that the lifetimes of the various parts of the printer 100 are kept long. For example, in the calibration of the discharge current control, the discharge occurs between the photosensitive drum 1 and the charging roller 2, and therefore, the reduction of the number of the calibrations can reduce the photosensitive drum scraping.

In this embodiment, the ambient condition is divided into three sections depending on the temperature and humidity, but this is not inevitable, and the ambient condition may be divided only on the temperature or humidity. For example, the temperature is significantly influential to the discharge current. Therefore, the ambient condition may be grouped only on the temperature.

The groups may include high temperature, normal temperature, and low temperature ambient conditions. Only when the ambient condition changes from one group to another, the calibration is carried out.

When the temperature is high, the discharge easily occurs between the photosensitive drum 1 and the charging roller 2. Generally, therefore, the AC voltage applied to the charging roller 2 from the charging bias voltage generation circuit 6 is decreased with increase of the temperature to decrease the peak voltage value of the AC current flowing into the charging roller 2. With the calibration, the correct measurement of the discharge current value is accomplished, and therefore, in the subsequent image formation, the MPU 5 can properly decrease the current flowing into the charging roller 2 from the charging bias voltage generation circuit6. In other words, the discharge current can be maintained at constant.

However, the foregoing is a fundamental tendency, and the control system may be modified properly depending on the properties of the charging roller 2 and/or the photosensitive drum 1, and the use situation. For example, in the case that the calibration is carried out after an increase of the temperature, the reduction of the AC current and/or the AC voltage outputted by the charging bias voltage generation circuit 6 is not always carried out in the subsequent image forming operation. The AC current may remain unchanged, or even increased.

Embodiment 2

Embodiment 2 of the present invention will be described. Basic structures of the printer 100 (image forming apparatus) according to this Embodiment 2 are similar to the printer 100 of Embodiment 1, but detects ID (identification) of the process cartridge (CRG) 112 in the discrimination of the necessity of the calibration after the recovery from sleeping.

Referring to a flow chart of FIG. 12 and a block diagram of FIG. 13, a series of charging high voltage control process steps at the time of the recovery from sleeping of the printer 100, according to this embodiment 2.

Upon start of the printing operation, in step S31, the sleeping detecting means 410 discriminates whether or not it is upon the recovery from sleeping. If not, the printing operation starts in step 32. When the print is started, the discharge current control step is carried out to effect the discharge current control. After completion of the printing, ambient condition information is stored in ROM 5*b* which is storing means 408 provided in the image forming apparatus through the ambience detecting means 407, in step 33, and the printing operation is finished.

On the other hand, if the discrimination in step 31 shows that it is upon the recovery from sleeping, the discriminating means 401 discriminates in step 31 whether or not the state of the CRG (the state of the image forming station 112) has changed from that before the recovery from sleeping. The means for detecting the state of the CRG will be described.

A memory 412 of the CRG 112 stores ID information for individual CRG. Upon the recovery from sleeping, the discriminating means 401 reads out the ID of the CRG 112 through an ID reading means (unit) 411 of the CRG 112. The thus read ID is written to the storing means 408 through the discriminating means 401.

The discriminating means 401 compares the ID (use history or exchange history) in the previous image formation and that in the current image formation, and if they are different, it is discriminated that the cartridge has been exchanged. In such a case, it is discriminated that the state of the CRG has changed, in this embodiment. When the state of the CRG has changed, the operation goes to step 36, in which a calibration for discharge current control (FIG. 10) is carried out and then to the printing operation of step 32.

If the states of the CRG are the same, the discrimination is made as to whether or not the ambient condition has changed in step 37. In step 37, the comparison is made between the previous ambient condition state stored in the recording means 406 and the current ambient condition state detected by the ambience detecting means 407, and the discriminating means 401 discriminates whether or not the ambient condition has changed. If the change of the ambient condition is discriminated in step 36, the calibration operation is carried out, and if not the calibration operation is not carried out, and the operation goes to step 32 to carry out the printing operation.

The calibration for the discharge current control is not carried out if the operation is after the recovery from sleeping and the state of the CRG and the ambient condition remain unchanged. This is because the correction value before the recovery from sleeping is usable for the discharge current control in the current operation because of the no changes in the CRG state (use history or exchange history) or in the ambient condition.

As described in the foregoing, the calibration for the discharge current control is not carried out during the multiple pre-rotation step, in the case that the ambient condition or the state of the CRG has not changed upon the recovery from sleeping. With such structures, upon the recovery from sleeping, high precision discharge amount and therefore uniform charging effect can be accomplished while suppressing extension of the driving time, irrespective of the variation of the ambient condition and/or property variations of the charging members due to the manufacturing tolerances.

In this embodiment, the state of the CRG is discriminated by ID of the CRG 112, but this is not inevitable, and for example, the discrimination may be made on the comparison of the state of the CRG on the basis of the print number or use state of the CRG 112.

Generally, the tendency of discharging between the charging roller and the photosensitive drum is different depending on a thickness of the photosensitive layer film of the photosensitive drum. If it is predicted that the state detection of the CRG 112 exhibits a significant changing of the film thickness of the photosensitive drum, it is desired that the calibration of the discharge current detecting means is carried out.

Generally, the film thickness of the photosensitive drum is the largest when the CRG 112 is fresh, and it decreases with the use of the CRG 112. In the state that the film thickness of the photosensitive drum is large, the discharge tends to occur. On the contrary, if the film thickness is small, the discharge tends less to occur. Therefore, when the CRG 112 is replaced by a new one, it is desired to carry out the calibration. The replacement means that the film thickness of the photosensitive drum has increased, and therefore, generally speaking, in the image formation after the calibration, it is likely that the control for decreasing the charging AC voltage (for decreasing the AC current flowing into the charging roller) is carried out.

In addition, the use history (use time) of the CRG 112 is divided into a plurality of groups, and if the use history belongs to a different group, the calibration is desirable. For example, the use time of the CRG 112 and/or the photosensitive drum is measured and is stored in the storing means 408. The total of the use time is grouped into a short term group, a middle term group and a long term group, for example. The calibration is carried out if the use time belongs to the middle-term group from the short-term group, or from the middle-term group to the long-term group. When such a calibration is carried out, generally speaking, in the image formation after the calibration, as the total of the use time increases, it is likely that the control for increasing the charging AC voltage (for decreasing the AC current flowing into the charging roller) is carried out.

The calibration control of this embodiment is an example. For example, it is possible that the film thickness of the photosensitive drum is thin at the time when a new CRG 112 is mounted. In such a case, the control is not always to decrease the charging AC voltage in the image formation after the calibration. In addition, with the increase of the use time of the CRG 112, it is possible that an externally added material of the toner is deposited on the photosensitive drum and/or the charging roller with the result that the discharge rather tends to occur between the photosensitive drum and the charging roller. In such a case, even when the total of the use time of the CRG 112 or the photosensitive drum increases (when the use time thereof exceeds a predetermined time), the AC charging voltage is to be decreased in the discharge current control after the calibration. In other words, it is possible that when the use time of the CRG 112 increases, the calibration results in that the set point of the charging current into the charging roller 2 from the charging bias voltage generation circuit 6 in the subsequent discharge current control is decreased.

[Others]

1) In the present invention, the image forming apparatus is not limited to the printer of the electrophotographic image formation type as in the embodiments described above. It may be a copying machine, a facsimile machine, a complex function machine or the like.

2) It may be a copying machine, a printer, a facsimile machine, a complex function machine or the like of an electrostatic recording image formation type using a dielectric member for electrostatic recording as the image bearing member. In this case, the dielectric member for electrostatic recording is uniformly charged by a contact charging member, and then an electrostatic latent image is formed by selectively discharging the dielectric member for electrostatic recording using a discharging needle or an electron gun or the like, and the electrostatic latent image is developed into a toner image.

3) The image forming apparatus includes an image display device (display screen device, electronic black board device, electronic white board device or the like) in which an image formed on the image bearing member such as the electrophotographic photosensitive member or the dielectric member for electrostatic recording is displayed on a display portion.

According to the present invention, the time necessary for the calibration is suppressed, whereas the high precision discharge in a predetermined amount and therefore uniform charging is possible, irrespective of the variation in the ambient condition or the property variation of the charging member due to the manufacturing tolerances or the like.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application Nos. 113522/2012 and 063797/2013 filed May 17, 2012, and Mar. 26, 2013, respectively, which are hereby incorporated by reference herein in their entirety.

What is claimed is:

1. An image forming apparatus for forming an image on a recording material, said image forming apparatus comprising:

an image bearing member;

a charging member for charging said image bearing member by applying a voltage thereto while contacting said image bearing member;

an AC voltage generating unit for generating and applying an AC voltage to said charging member;

a state detecting unit for detecting a state of said image forming apparatus including an ambient condition under which said image forming apparatus is used;

a storing unit for storing the ambient condition detected by said state detecting unit;

a discharge current detecting unit for detecting a discharge current between said charging member and said image bearing member;

a discharge current control unit for controlling said AC voltage generating unit on the basis of a result of detection of said discharge current detecting unit; and a discriminating unit for discriminating whether to calibrate said discharge current detecting unit to reduce the influence of a change of the state of said image forming apparatus on detection of the discharge current by said discharge current detecting unit before formation of the image, in accordance with a result of detection of said state detecting unit, wherein said discriminating unit stores a plurality of groups of ambient condition data, wherein said discriminating unit indicates that the calibration is necessary when said discriminating unit discriminates that the ambient condition currently detected by said state detecting unit falls in a group which is different from a group in which the ambient condition previously detected by said state detecting unit falls, and said discriminating unit indicates that the calculation is unnecessary when said discriminating unit discriminates that the ambient condition currently detected by said state detecting unit falls in a group which is the same as the group in which the ambient condition previously detected by said state detecting unit falls, wherein said AC voltage generating unit applies the AC voltage to said charging member in calibration of said discharge current detecting unit, and wherein said discharge current control unit effects the calibration using the AC voltage applied to said charging member and a differential value of the AC voltage, when said discriminating unit indicates that the calibration is necessary.

2. An apparatus according to claim 1, wherein execution of the discrimination of said discriminating unit and execution of the calibration are carried out in a period after recovery from a rest state of said image forming apparatus and before formation of the image.

3. An apparatus according to claim 1, wherein in execution of the calibration, said AC voltage generating unit applies to said charging member an AC voltage having a peak voltage lower than a discharge starting voltage at which the discharge between said charging member and said image bearing member starts.

4. An apparatus according to claim 1, wherein the ambient condition is a temperature.

5. An apparatus according to claim 4, wherein when the calibration is executed as a result that the temperature detected by said state detecting unit is higher than a previous detected temperature, said AC voltage generating unit makes the peak voltage of the AC voltage applied to said charging member lower than the peak voltage of the AC voltage applied to said charging member in the image formation before execution of the calibration.

6. An apparatus according to claim 1, wherein the state of said image forming apparatus detected by said state detecting unit includes a use history of an image forming station.

7. An apparatus according to claim 1, wherein the state of the image forming apparatus detected by said state detecting unit includes an exchange history of an image forming station.

8. An apparatus according to claim 7, wherein when the calibration is executed as a result of replacement of said image forming station, said AC voltage generating unit makes the peak voltage of the AC voltage applied to said charging member lower than the peak voltage of the AC voltage applied to said charging member in the image formation before execution of the calibration.

9. An apparatus according to claim 1, wherein said discharge current control unit controls said AC voltage generating unit so that a constant AC current based on a control value flows into a path for supplying a current in said charging member from said AC voltage generating unit, and wherein the control value is set on the basis of a discharge current detected by said discharge current detecting unit during the image formation.

10. An apparatus according to claim 1, wherein said discharge current detecting unit includes a first outputting unit, connected through a capacitor with a path for supplying a current in said charging member, for outputting information in accordance with a peak voltage of the AC voltage applied to said charging member, and a second outputting unit, connected with the path through a capacitor, for outputting information in response to a change of the AC voltage applied to said charging member.

11. An apparatus according to claim 10, wherein in execution of the calibration, said AC voltage generating unit generates an AC voltage having a peak voltage lower than a discharge starting voltage at which the discharge starts between said charging member and said image bearing member, and said discharge current detecting unit uses output results of said first outputting unit and said second outputting unit.

12. An apparatus according to claim 10, wherein said discharge current control unit controls said AC voltage generating unit on the basis of a difference between an output result of said first outputting unit and an output result of said second outputting unit.

13. An apparatus according to claim 1, wherein said discharge current control unit controls an AC current flowing into said charging member from said AC voltage generating unit so that the discharge current detected by said discharge current detecting unit during image formation is at a predetermined level.

* * * * *